US008613160B2

(12) United States Patent
Matsumoto et al.

(10) Patent No.: US 8,613,160 B2
(45) Date of Patent: Dec. 24, 2013

(54) DOOR OPENING AND CLOSING APPARATUS FOR VEHICLE

(75) Inventors: Keisuke Matsumoto, Anjo (JP); Yoshitaka Kato, Anjo (JP); Toshitsugu Oda, Okazaki (JP); Tomoaki Nishimura, Kariya (JP)

(73) Assignee: Aisin Seiki Kabushiki Kaisha, Kariya-Shi, Aichi-Ken (JP)

( * ) Notice: Subject to any disclaimer, the term of this patent is extended or adjusted under 35 U.S.C. 154(b) by 146 days.

(21) Appl. No.: 12/971,595

(22) Filed: Dec. 17, 2010

(65) Prior Publication Data

US 2011/0154740 A1 Jun. 30, 2011

(30) Foreign Application Priority Data

Dec. 25, 2009 (JP) ..... 2009-294642

(51) Int. Cl.
*E05F 15/00* (2006.01)

(52) U.S. Cl.
USPC ..... 49/279; 49/280; 49/360

(58) Field of Classification Search
USPC ..... 49/279, 280, 358, 359, 360; 292/198, 292/216, DIG. 23
See application file for complete search history.

(56) References Cited

U.S. PATENT DOCUMENTS 4,848,031 A * 7/1989 Yamagishi et al. ..... 49/280
5,216,838 A * 6/1993 DeLand et al. ..... 49/280
5,632,120 A * 5/1997 Shigematsu et al. ..... 49/449
5,684,470 A * 11/1997 DeLand et al. ..... 340/12.5
5,867,940 A * 2/1999 Watanaba et al. ..... 49/360
6,135,513 A 10/2000 Hamada et al.
6,178,699 B1 * 1/2001 Kawanobe et al. ..... 49/360
6,198,242 B1 * 3/2001 Yokomori et al. ..... 318/445
6,405,485 B1 * 6/2002 Itami et al. ..... 49/280
6,739,646 B2 * 5/2004 Suzuki et al. ..... 296/155
6,751,851 B2 * 6/2004 Ninomiya et al. ..... 29/718

(Continued)

FOREIGN PATENT DOCUMENTS

JP 11-81769 A 3/1999
JP 2001-182401 A 7/2001

(Continued)

OTHER PUBLICATIONS

Japanese Office Action issued Aug. 27, 2013 by the Japanese Patent Office in Japanese Patent Application No. 2009-294642 and partial English translation (6 pgs).

*Primary Examiner* — Katherine Mitchell
*Assistant Examiner* — Abe Massad
(74) *Attorney, Agent, or Firm* — Buchanan Ingersoll & Rooney PC

(57) ABSTRACT

A door opening and closing apparatus for a vehicle, includes a latch mechanism adapted so as to retain a vehicle door in a closed state relative to a vehicle body, an outside lever provided within a space formed inside of the vehicle door so as to be positioned closer to an interior of the vehicle and linked to an outside handle adapted to be rotatably supported by the vehicle door, a detection switch detecting an operation to the outside handle when the outside lever contacts the detection switch in response to an operation of the outside lever, and a release device releasing a retention of the vehicle door in the closed state by means of the latch mechanism by the release device actuating the latch mechanism when a rotational operation of the outside handle is detected by the detection switch while the vehicle door is in a locked state.

22 Claims, 12 Drawing Sheets

(56) References Cited

U.S. PATENT DOCUMENTS

| | | | | |
|---|---|---|---|---|
| 6,955,389 | B2 * | 10/2005 | Suzuki et al. | 296/146.4 |
| 7,288,907 | B2 * | 10/2007 | Kamiya et al. | 318/266 |
| 7,360,337 | B2 * | 4/2008 | Yoneyama | 49/281 |
| 7,708,334 | B2 * | 5/2010 | Yamada et al. | 296/146.4 |
| 7,815,229 | B2 | 10/2010 | Ooe et al. | |
| 2002/0124469 | A1 * | 9/2002 | Rogers et al. | 49/360 |
| 2008/0136195 | A1 * | 6/2008 | Ooe et al. | 292/198 |
| 2012/0056437 | A1 * | 3/2012 | Takayanagi et al. | 292/118 |

FOREIGN PATENT DOCUMENTS

| | | | |
|---|---|---|---|
| JP | 2006-233447 | A | 9/2006 |
| JP | 2006-328897 | A | 12/2006 |
| JP | 2008-144402 | A | 6/2008 |

* cited by examiner

DOOR OPENING AND CLOSING APPARATUS FOR VEHICLE

CROSS REFERENCE TO RELATED APPLICATIONS

This application is based on and claims priority under 35 U.S.C. §119 to Japanese Patent Application 2009-294642, filed on Dec. 25, 2009, the entire content of which is incorporated herein by reference.

TECHNICAL FIELD

This disclosure generally relates to a door opening and closing apparatus for a vehicle.

BACKGROUND DISCUSSION

There exist various door opening and closing apparatuses for a vehicle. An example of the door opening closing apparatuses is disclosed in JP2008-144402A. The door opening and closing apparatus for the vehicle disclosed in JP2008-144402A is configured so as to recognize that a user (an authorized user) is approaching to the vehicle when the user carrying a portable device (an electronic key) is within a predetermined area relative to the vehicle whose doors are locked and when an identification signal (an ID signal) outputted from the portable device to the vehicle through a wireless communication is verified. In a case where the user operates a switch provided at an outside handle of the vehicle under the above-described condition, the door opening and closing apparatus disclosed in JP2008-144402A detects an intention of the user that the user intends to open a vehicle door. Then, for example, the door opening and closing apparatus disclosed in JP2008-144402A actuates a locking actuator and a release actuator. Accordingly, a latch mechanism, that keeps the vehicle door locked, is released, thereby allowing the vehicle door to be opened.

Another example of the door opening and closing apparatuses is disclosed in JP2006-233447A. A door handle apparatus disclosed in JP2006-233447A includes a switch, which is provided at an outside handle of a vehicle and which is configured so as to detect a holding of the outside handle by a user as an intention of the user that intends to open a vehicle door.

According to the disclosures in JP2008-144402A and JP2006-233447A, the switch is provided at the outside handle. Therefore, a water resistance of the switch may not be sufficiently ensured. Furthermore, because only a limited space within the outside handle is allocated for the detection switch, freedom in arrangement of the switch within the outside handle may be limited.

A need thus exists for a door opening and closing apparatus for a vehicle which is not susceptible to the drawback mentioned above.

SUMMARY

According to an aspect of this disclosure, a door opening and closing apparatus for a vehicle, includes a latch mechanism adapted so as to retain a vehicle door in a closed state relative to a vehicle body, an outside lever adapted to be provided within a space formed inside of the vehicle door so as to be positioned closer to an interior of the vehicle and linked to an outside handle adapted to be rotatably supported by the vehicle door, a detection switch detecting an operation to the outside handle when the outside lever contacts the detection switch in response to an operation of the outside lever, and a release device releasing the retention of the vehicle door in the closed state by means of the latch mechanism in a manner where the release device actuates the latch mechanism when a rotational operation of the outside handle is detected by the detection switch while the vehicle door is in a locked state.

BRIEF DESCRIPTION OF THE DRAWINGS

The foregoing and additional features and characteristics of this disclosure will become more apparent from the following detailed description considered with the reference to the accompanying drawings, wherein.

DETAILED DESCRIPTION

An embodiment of a door opening and closing apparatus for a vehicle will be described below in reference to the attached drawings. In this embodiment, the door opening and closing apparatus is assumed to be adapted to an electronic key system (a so-called smart entry system: registered trademark), which is configured so as to switch a state of a vehicle door from a locked state to an unlocked state upon a verification of a user (an authorized user) through a wireless communication between the door opening and closing apparatus and a portable device (an electronic key) carried by the user.

Figure 1:
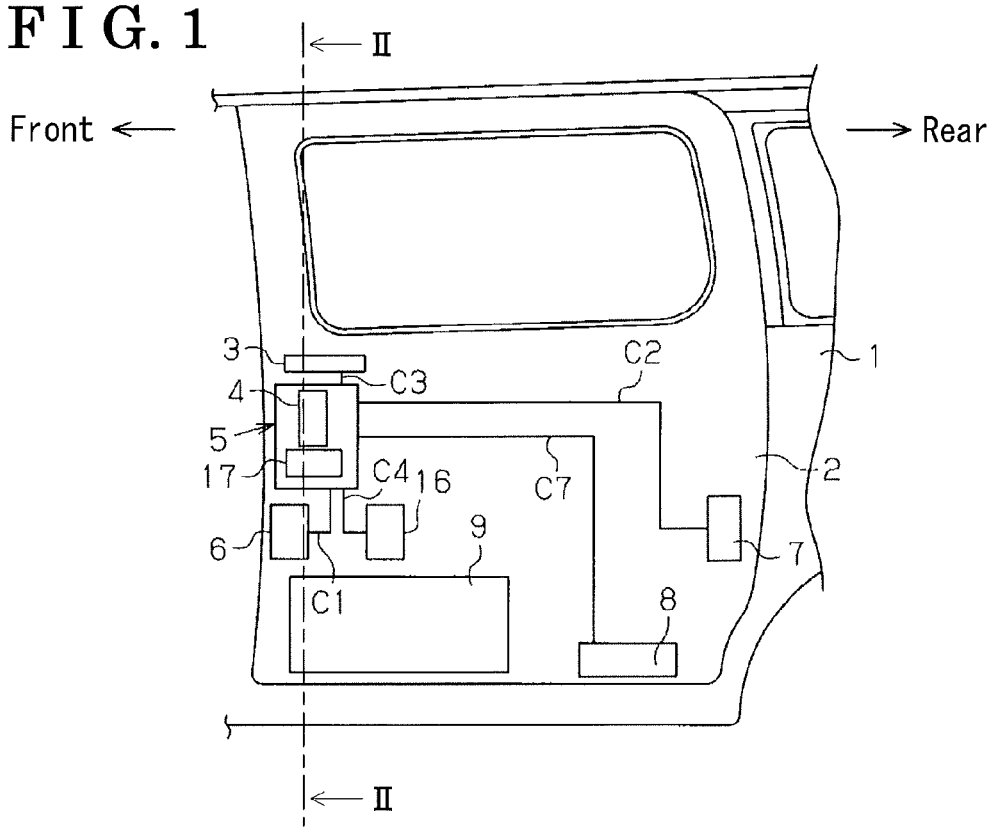
FIG. 1 is an elevation view schematically illustrating a vehicle door to which a door opening and closing apparatus for a vehicle according to an embodiment is adapted.

As illustrated in FIG. 1, a slide door 2, which serves as a vehicle door, is supported at a side portion of a vehicle body 1 via an appropriate supporting member while allowing the slide door 2 to be moveable in a front-rear direction of the vehicle. The slide door 2 opens and closes an opening portion formed at the vehicle body 1 through which a passenger gets in and out from the vehicle, in response to a movement of the slide door 2 in the front-rear direction.

Figure 2:
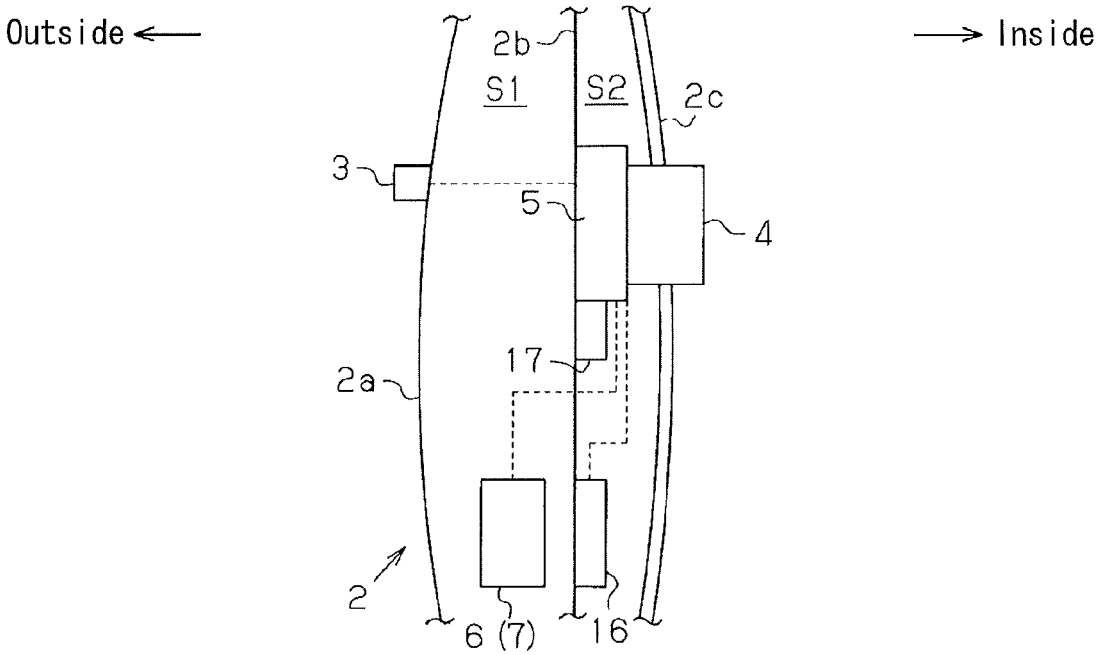
FIG. 2 is s cross-sectional diagram of the vehicle door taken along line II-II in FIG. 1.

An outside handle 3, which is formed in a substantially arched shape and which extends in the front-rear direction of the vehicle, is connected to a front portion on an outer surface of the slide door 2 while allowing the outside handle 3 to be pivotable about a rear end portion thereof as a fulcrum. More specifically, as schematically illustrated in FIG. 2, the slide door 2 includes a door outer panel 2*a*, a door inner panel 2*b* provided within the slide door 2, and a door trim 2*c* provided so as to face an interior of the vehicle and so as to cover the door inner panel 2*b* from the interior of the vehicle. The outside handle 3 is provided at the door outer panel 2*a* so as to be exposed to an outside of the vehicle. A space formed within the slide door 2 is divided into a space S1 and a space S2 by means of the door inner panel 2*b*. More specifically, the space S1 is formed so as to be positioned closer to the outside of the vehicle relative to the door inner panel 2*b* and the space S2 is formed so as to be positioned closer to the interior of the vehicle relative to the door inner panel 2*b*. Additionally, the outside handle 3 may be provided at the slide door 2 so as to be pivotable about a front end portion of the outside handle 3 as the fulcrum. Furthermore, a shape of the outside handle 3 is not limited to the substantially arched shape. For example, the outside handle 3 may be formed so as to extend in an up-and-down direction of the vehicle.

As illustrated in FIG. 1, an inside handle 4, which is formed so as to extend in the up-and-down direction of the vehicle, is provided at a front portion on an inner surface of the slide door 2 facing the interior of the vehicle while allowing the inside handle 4 to be pivotable about an intermediate portion thereof as a fulcrum. More specifically, as illustrated in FIG. 2, the inside handle 4 is supported by the door inner panel 2*b* via a remote controller 5 (a relay device) in a state where the inside handle 4 is exposed to the interior of the vehicle from an opening formed at the door trim 2*c*. Furthermore, the remote controller 5, which is linked to each of the outside handle 3 and the inside handle 4, is provided in the space S2 formed within the door inner panel 2*b*.

Figure 5:
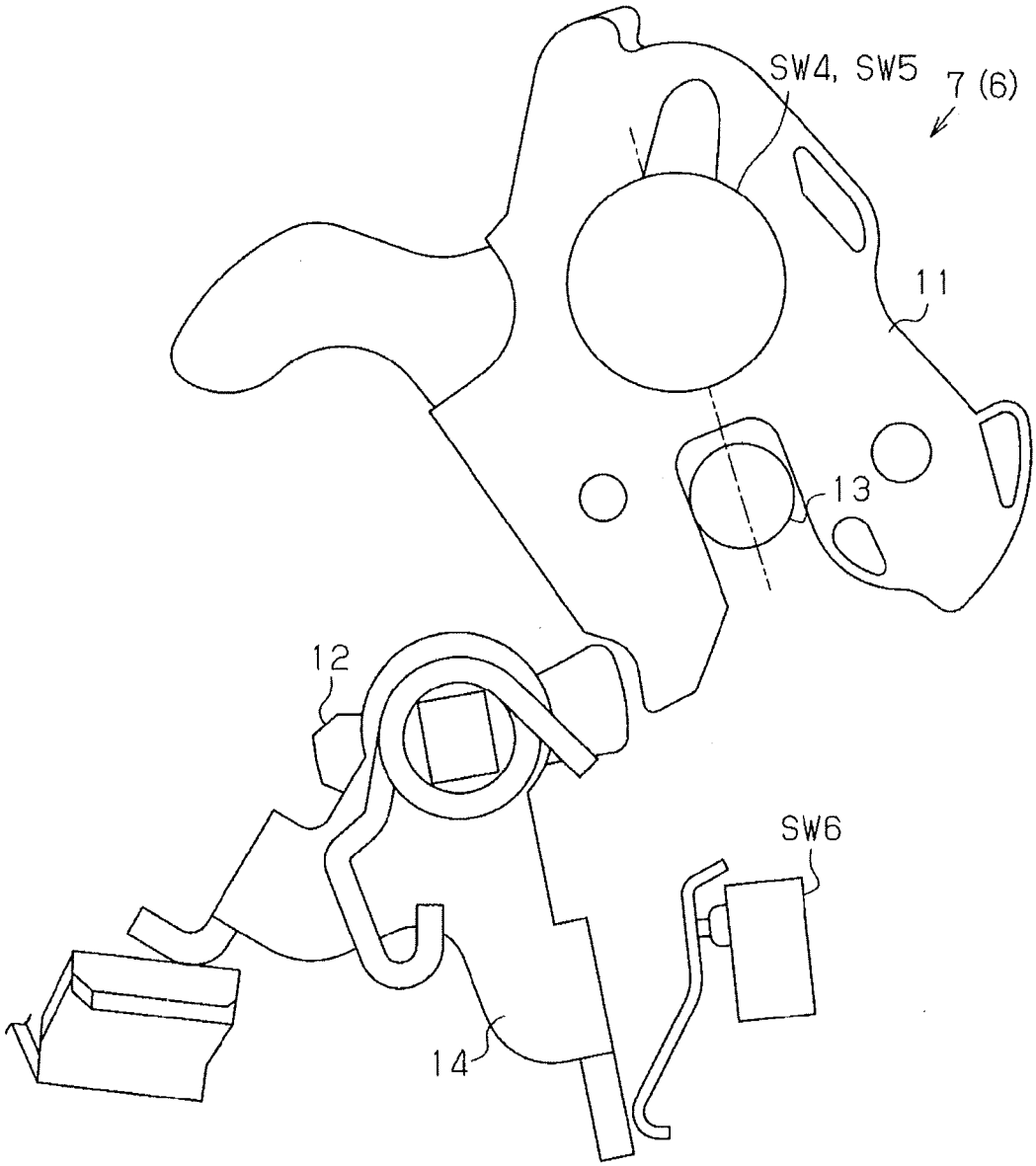
FIG. 5 is a diagram schematically illustrating a front locking member and a rear locking member.

As illustrated in FIG. 1, a front locking member 6 and a rear locking member 7, each of which serves as a latch mechanism, are provided at a front portion and a rear portion, respectively, within the slide door 2 so as to be apart from each other in the front-rear direction. Furthermore, a fully-opened-state retaining member 8 is provided within the slide door 2 so as to be positioned at a lower portion thereof. As illustrated in FIG. 2, the front locking member 6 and the rear locking member 7 are provided in the space S1 within the slide door 2. Furthermore, the front locking member 6 and the rear locking member 7 are configured so as to engage with the vehicle body 1 in order to retain the slide door 2 in a closed state (including a fully-closed state and a partially closed state). More specifically, as illustrated in FIG. 5, each of the front locking member 6 and the rear locking member 7 includes a latch 11 and a pawl 12. The latch 11 of each of the front locking member 6 and the rear locking member 7 is configured so as to be engageable with a striker 13, which is fixed on the vehicle body 1, in order to retain the slide door 2 to be in the closed state relative to the vehicle body 1. More specifically, the slide door 2 is closed in a manner where the latch 11 is rotated so as to engage with the striker 13, and simultaneously, the pawl 12 prevents the latch 11 from being rotated (i.e. the pawl 12 locks the latch 11 so as not to be rotated), thereby retaining the slide door 2 to be in the closed state relative to the vehicle body 1. Furthermore, each of the front locking member 6 and the rear locking member 7 is linked to the remote controller 5 at the pawl 12. When the pawl 12 is moved in response to a force transmitted thereto from the remote controller 5 in order to release the detent of the latch 11, the latch 11 is rotated by a biasing force of a return spring to an initial position, which releases the engagement between the latch 11 and the striker 13. As a result, the slide door 2 is turned to be a state where the slide door 2 is openable relative to the vehicle body 1. The fully-opened-state retaining member 8 is provided in the space S1 within the slide door 2 and is configured so as to be engageable with the vehicle body 1 in order to retain (lock) the slide door 2 to be in a fully-opened state. The fully-opened-state retaining member 8 is also linked to the remote controller 5, so that the fully-opened-state retaining member 8 is actuated in a similar manner as described above in response to the force transmitted thereto from the remote controller 5 in order to allow the slide door 2 to be closed relative to the vehicle body 1.

As illustrated in FIG. 2, a release actuator 16, which serves a release device, is attached on the door inner panel 2*b* so as to be positioned in the space S2. The release actuator 16 is linked to the remote controller 5, so that the release actuator 16 transmits a force generated thereat to each of the front locking member 6, the rear locking member 7, and the fully-opened-state retaining member 8 via the remote controller 5 in order to turn the slide door 2 to be in an openable state and a closable state in a similar manner as described above. Furthermore, a locking actuator 17, which serves a switching drive device, is supported at the remote controller 5. The locking actuator 17 is configured so as to switch a state of the slide door 2 between a locked state and an unlocked state. In the case where the slide door 2 is in the locked state, even if, for example, the outside handle 3 is rotatably operated by the user, an operation force inputted thereto is not transmitted to the front locking member 6 and the rear locking member 7 by the remote controller 5, and therefore, the slide door 2 is not turned to be in the openable state (i.e. a state that allows the slide door 2 to be opened). On the other hand, in the case where the slide door 2 is in the unlocked state, for example, when the user rotatably operates the outside handle 3, the operation force inputted thereto is transmitted to the front locking member 6 and the rear locking member 7 by the remote controller 5, thereby turning the slide door 2 to be in the openable state.

Figure 3:
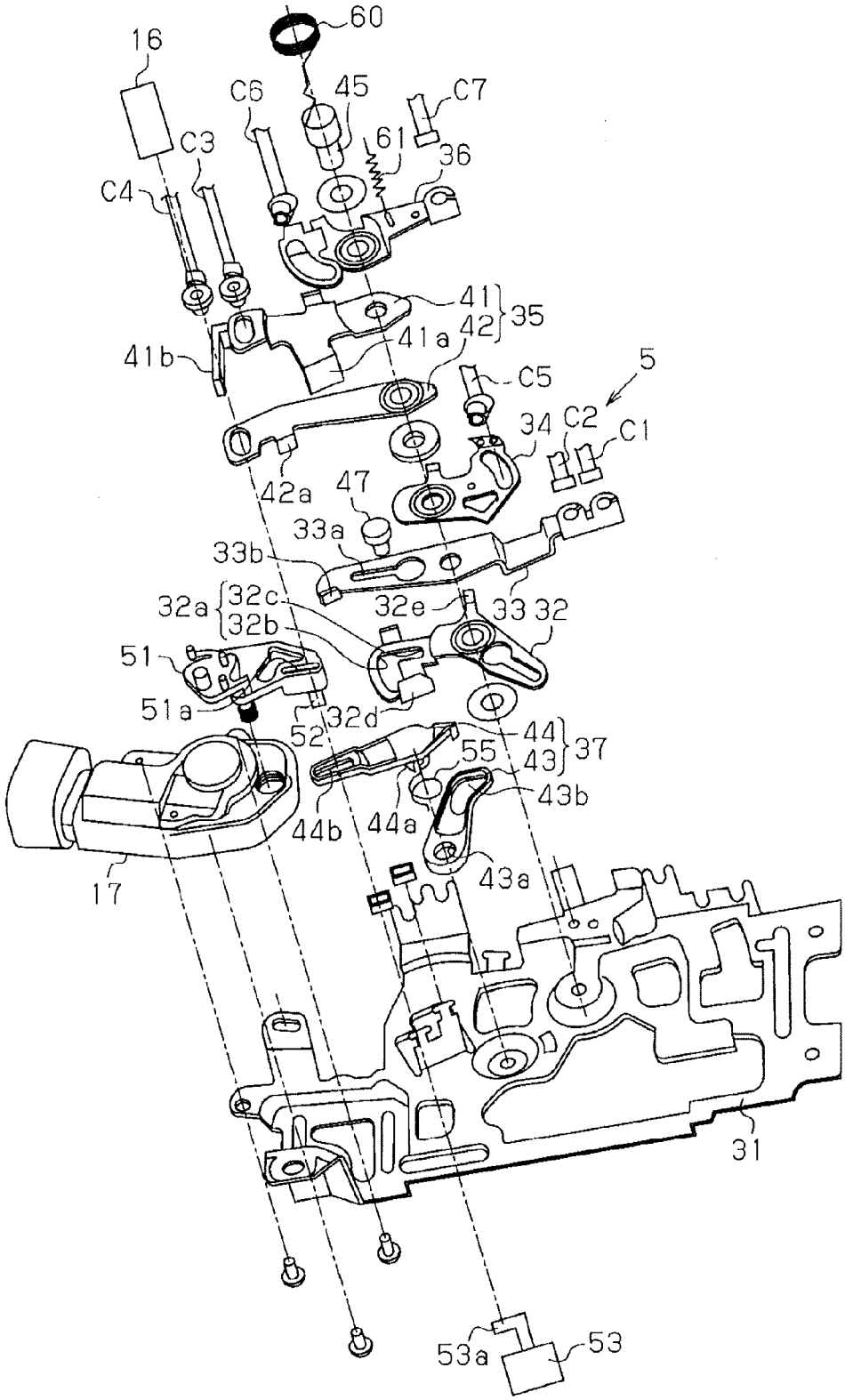
FIG. 3 is an exploded perspective view of a remote controller according to the embodiment.
Figure 4:
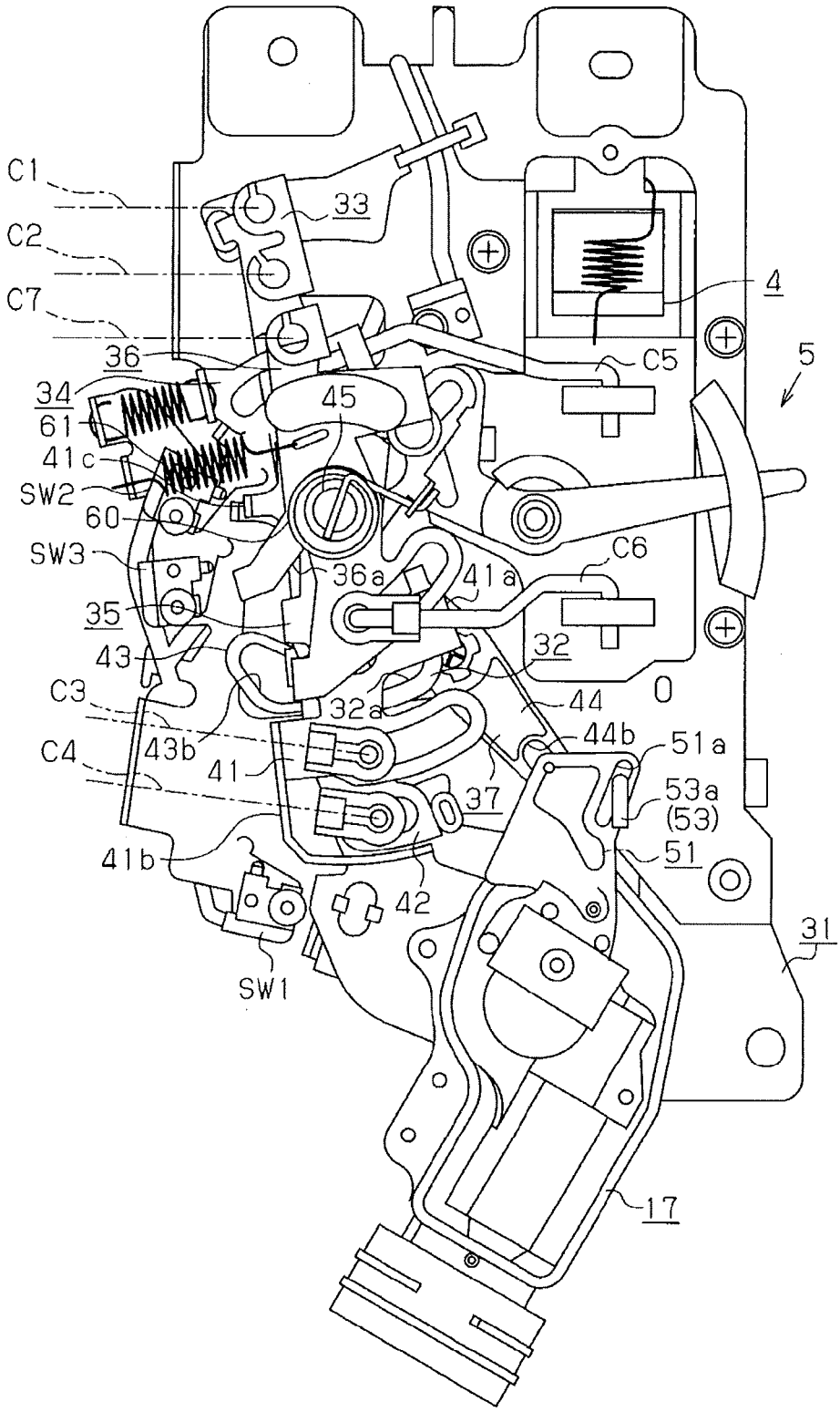
FIG. 4 is an elevation view of the remote controller according to the embodiment.

As illustrated in FIG. 1, a power slide door apparatus 9 (an opening and closing device), which is configured so as to electrically open and close the slide door 2, is provided within the slide door 2. A detailed explanation about the remote controller 5 will be given below. Illustrated in FIG. 3 is an exploded perspective view of the remote controller 5. Illustrated in FIG. 4 is an elevation view of the remote controller 5. As illustrated in FIGS. 3 and 4, the remote controller 5 includes a base bracket 31, an open lever 32, a lift lever 33 serving as a relay lever, an inside lever 34, an outside lever 35, a fully-open-locked state releasing lever 36, and a locking lever 37 serving as a locking-and-unlocking state switching device. The outside lever 35 is configured with an outside handle lever 41 serving as a first lever and a release lever 42 serving as a second lever. The locking lever 37 includes a first locking lever 43 and a second locking lever 44, which are configured so as to be rotatable relative to each other within a predetermined angular range. The open lever 32, the lift lever 33, the inside lever 34, the outside lever 35 (the outside handle lever 41 and the release lever 42) and the fully-open-locked state releasing lever 36 are connected to the base bracket 31 so as to be freely rotatably about a rotary shaft 45.

The lift lever 33 is rotatably supported by the rotary shaft 45 at an intermediate portion of the lift lever 33 in a longitudinal direction thereof. A first end portion of the lift lever 33 is connected to each of the pawls 12 of the respective front locking member 6 and the rear locking member 7 via corresponding cables C1 and C2. An elongated hole 33*a*, which extends in a radial direction relative to the rotary shaft 45, is formed at a second end portion of the lift lever 33. Furthermore, an engagement flange 33*b* is formed at the second end portion of the lift lever 33 at a position closer to an edge portion thereof relative to the elongated hole 33*a* so as to extend in a thickness direction thereof towards the outside lever 35 (the release lever 42).

The open lever 32 is rotatably supported by the rotary shaft 45 at an intermediate portion of the open lever 32. An insertion hole 32*a*, which is formed in a substantially L-shape, is formed at an end portion of the open lever 32. The insertion hole 32*a* includes a first elongated hole 32*b* formed in an arc-shape centering on the rotary shaft 45 and a second elongated hole 32*c* continuously extending from the first elongated hole 32*b* in the radial direction relative to the rotary shaft 45. An engagement flange 32*d* is formed on the open lever 32 in the vicinity of the insertion hole 32*a* so as to extend in a thickness direction thereof towards the outside lever 35 (the outside handle lever 41).

The outside handle lever 41 of the outside lever 35 is rotatably supported by the rotary shaft 45 at a first end portion of the outside handle lever 41. A second end portion of the outside handle lever 41 is linked to the outside handle 3 via a cable C3. Accordingly, when the outside handle 3 is rotatably operated, an operation force inputted thereto is transmitted to the outside handle lever 41, thereby rotating the outside handle lever 41. Furthermore, an engagement flange 41*a* is formed on the outside handle lever 41 so as to extend in a thickness direction thereof towards the open lever 32. More specifically, the engagement flange 41*a* is arranged on the outside handle lever 41 so as to face the engagement flange 32*d* of the open lever 32 on a rotation trajectory of the outside handle lever 41 about the rotary shaft 45. Therefore, when the engagement flange 32*d* of the open lever 32 is pressed by the engagement flange 41*a* of the outside handle lever 41 in response to a rotation of the outside handle lever 41 in one direction (a first direction), the open lever 32 is rotated together with the outside handle lever 41 as a unit. Additionally, a switch contact piece 41*b*, which is formed in a substantially L-shape, is formed so as to extend in a width direction orthogonal to the thickness direction thereof and so as to be positioned to cover an edge portion of the release lever 42 (see FIG. 4).

The release lever 42 is rotatably supported by the rotary shaft 45 at a first end portion of the release lever 42 independently of the outside handle lever 41 (i.e. the release lever 42 is supported by the rotary shaft 45 so as to be rotatable about the rotary shaft 45 independently of the outside handle lever 41). Furthermore, the release lever 42 is linked to the release actuator 16 at a second end portion via a cable C4. Accordingly, when the release actuator 16 is actuated, the force generated by the release actuator 16 is transmitted to the release lever 42, thereby rotating the release lever 42. An engagement flange 42*a* is formed at the release lever 42 so as to extend in a thickness direction thereof towards the lift lever 33. More specifically, the engagement flange 42*a* is arranged on the release lever 42 so as to face the engagement flange 33*b* of the lift lever 33 on a rotation trajectory of the release lever 42 about the rotary shaft 45. Accordingly, when the engagement flange 33*b* of the lift lever 33 is pressed by the engagement flange 42*a* of the release lever 42 in response to a rotation of the release lever 42 in one direction (a first direction), the lift lever 33 is rotated together with the release lever 42 as a unit. In other words, the lift lever 33 is configured so as to be rotatable in response to a rotational actuation of the release lever 42 in the first direction by the release actuator 16. Additionally, the engagement flange 33*b* may be omitted from the lift lever 33. In this case, the lift lever 33 may be configured so as to be directly pressed at a side surface thereof by the engagement flange 42*a* of the release lever 42.

The first locking lever 43 of the locking lever 37 includes a bearing hole 43*a* at a second end portion of the first locking lever 43. The second locking lever 44 includes a shaft portion 44*a*, which is formed at a first end portion of the second locking lever 44. Furthermore, the shaft portion 44*a* penetrates through the bearing hole 43*a* and is supported by the base bracket 31 while allowing the second locking lever 44 to be freely rotatable relative to the base bracket 31. In other words, the first and second locking levers 43 and 44 are configured so as to be rotatable relative to each other about the shaft portion 44*a*, which includes an axis extending in parallel with an axis of the rotary shaft 45. The second locking lever 44 (and the first locking lever 43) is rotatably supported by the base bracket 31 at an end portion of the shaft portion 44*a*, which penetrates through the bearing hole 43*a*.

Figure 7:
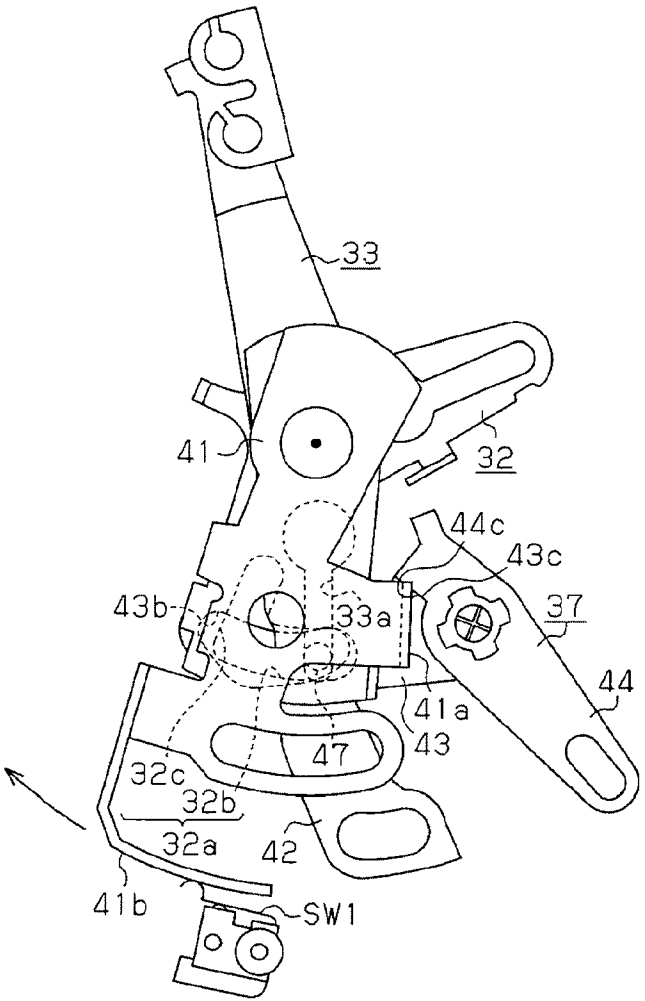
FIG. 7 is a diagram illustrating an operation of an outside handle lever while the locking lever is at the lock position.
Figure 6:
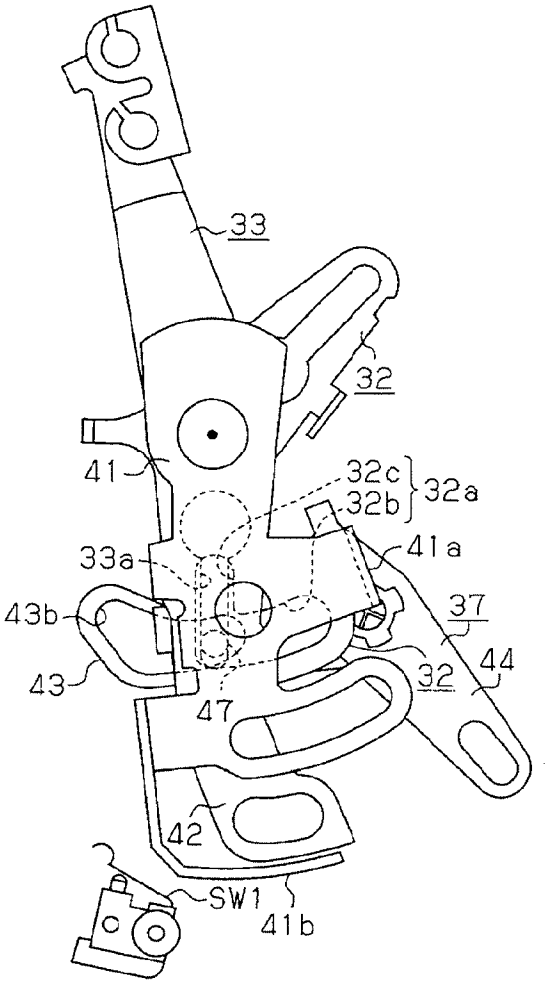
FIG. 6 is a diagram illustrating a locking lever of the remote controller according to the embodiment at a lock position.

An engagement surface 43*c* is formed on the first locking lever 43 in the vicinity of the bearing hole 43*a* (see e.g. FIG. 7). An engagement surface 44*c* is formed on the second locking lever 44 in the vicinity of the shaft portion 44*a*. The engagement surface 44*c* of the second locking lever 44 contacts and engages with the engagement surface 43*c* of the first locking lever 43. Therefore, a rotation of the second locking lever 44 relative to the first locking lever 43 in a counterclockwise direction in FIG. 6 is restricted (limited) to a predetermined angular range until the engagement surface 44*c* contacts the engagement surface 43*c*. A first end portion and a second end portion of a torque spring 55 (a biasing device), which is wound on the shaft portion 44*a*, are engaged with the first and second locking levers 43 and 44, respectively. Therefore, the first and second locking levers 43 and 44 are normally biased by the torque spring 55, so that the first and second locking levers 43 and 44 form a predetermined angle by which the engagement surfaces 43*c* and 44*c* engage (contact) with each other (i.e. which will be hereinafter referred to as an initial position). The torque spring 55 generates a biasing force in a circumferential direction, thereby generating an initial torque. In other words, the second locking lever 44 is configured so as to be rotatable relative to the first locking lever 43 in a clockwise direction in FIG. 6 while resisting the biasing force generated by the torque spring 55.

An elongated hole 43*b*, which is formed in an arc shape about the rotary shaft 45, is formed at a first end portion of the first locking lever 43. The elongated hole 43*b* is formed as a through hole so as to open towards the insertion hole 32*a* and the elongated hole 33*a* in the axial direction. A slide bush 47, which is formed in a substantially column shape, is inserted and penetrates through the insertion hole 32*a*, the elongated hole 33*a* and the elongated hole 43*b*. More specifically, the slide bush 47 is inserted so as to be slidably movable along the elongated hole 33*a*, the insertion hole 32*b* (the first and second elongated holes 32*b* and 32*c*) and along the elongated hole 43*b*.

As illustrated in FIGS. 6 and 7, when supposing that the first locking lever 43 (the locking lever 37) is positioned at a predetermined rotation position, to which the first locking lever 43 reaches when being rotated in the counterclockwise direction in FIG. 6, (i.e. which will be hereinafter referred to as a lock position), and the slide bush 47, which is guided along the elongated hole 43*b* of the first locking lever 43, is positioned at the first elongated hole 32*b* of the insertion hole 32*a*, which corresponds to an end portion of the elongated hole 33*a*, the open lever 32 is allowed to move relative to the lift lever 33 without causing an interference between the first elongated hole 32*b* and the slide bush 47 even if, for example, the open lever 32 is rotated together with the outside handle lever 41 in the clockwise direction in response to the rotational operation of the outside handle 3. Therefore, the lift lever 33 is not moved but remains at the initial position achieved while the locking lever 37 is at the lock position (see FIG. 7). Hence, the operation force inputted to the outside handle 3 is not transmitted to the lift lever 33 via the open lever 32. Accordingly, the front locking member 6 and the rear locking member 7, which retain the slide door 2 to be in the closed state, are not unlocked.

Figure 8:
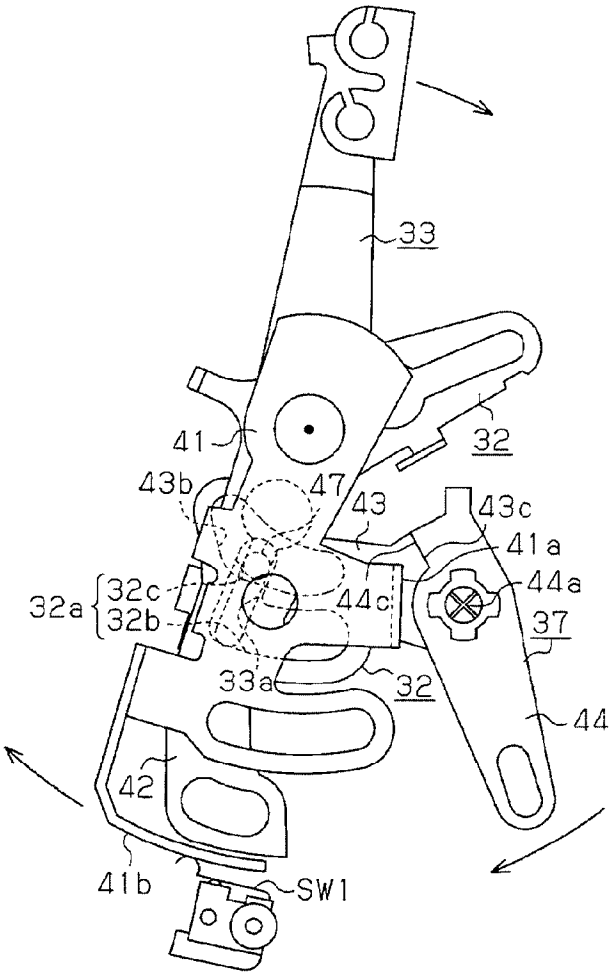
FIG. 8 is a diagram illustrating the locking lever at an unlock position.

On the other hand, as illustrated in FIG. 8, when supposing that the first locking lever 43 (the locking lever 37) is positioned at a predetermined rotation position, to which the first locking lever 43 reaches when being rotated in the clockwise direction in FIG. 8 (i.e. which will be hereinafter referred to as an unlock position), and the slide bush 47, which is guided along the elongated hole 43*b* of the first locking lever 43, is positioned at a portion of the second elongated hole 32*c* of the insertion hole 32*a* corresponding to a base end portion of the elongated hole 33*a*, for example, when the open lever 32 is rotated together with the outside handle lever 41 in the clockwise direction in FIG. 8 in response to a rotational operation of the outside handle 3, the slide bush 47 positioned at the second elongated hole 32*c* presses a side end portion of the elongated hole 33*a* of the lift lever 33, therefore, the lift lever 33 is rotated together with the outside handle lever 41 and the open lever 32 as a unit in the clockwise direction. As a result, the operation force inputted to the outside handle 3 is transmitted to the lift lever 33 via the open lever 32, so that the front locking member 6 and the rear locking member 7, which retain the slide door 2 to be in the closed state, are unlocked.

As illustrated in FIG. 3, an elongated hole 44*b* extending in a radial direction is formed at a second end portion of the second locking lever 44. An output lever 51, which is rotatably operated by the locking actuator 17, includes an engagement pin 52 so as to extend in a thickness direction of the output lever 51. The engagement pin 52 is slidably inserted into the elongated hole 44*b* of the second locking lever 44. Additionally, the locking actuator 17 is fixed on the base bracket 31. Therefore, when the output lever 51 is rotated in response to an actuation of the locking actuator 17, the second locking lever 44, whose elongated hole 44*b* is pressed by the engagement pin 52, is rotated together with the output lever 51 as a unit. As described above, generally, the first and second locking levers 43 and 44 are biased by the torque spring 55, so that the first and second locking levers 43 and 44 are rotated together as a unit. Hence, the first locking lever 43 is rotated between the lock position and the unlock position in response to a driving force of the locking actuator 17 transmitted to the first locking lever 43 via the output lever 51 and the like.

An elongated hole 51*a* is formed on the output lever 51. An engagement portion 53*a* of a lock knob 53, which is arranged in the vicinity of the inside handle 4, is slidably inserted into the elongated hole 51*a*. Hence, the first locking lever 43 is also rotatable between the lock position and the unlock position in response to the rotation of the output lever 51 by slidably operating the lock knob 53. Conversely, the lock knob 53 is actuated in response to the rotation of the first locking lever 43 together with the second locking lever 44 between the lock position and the unlock position.

Figure 9:
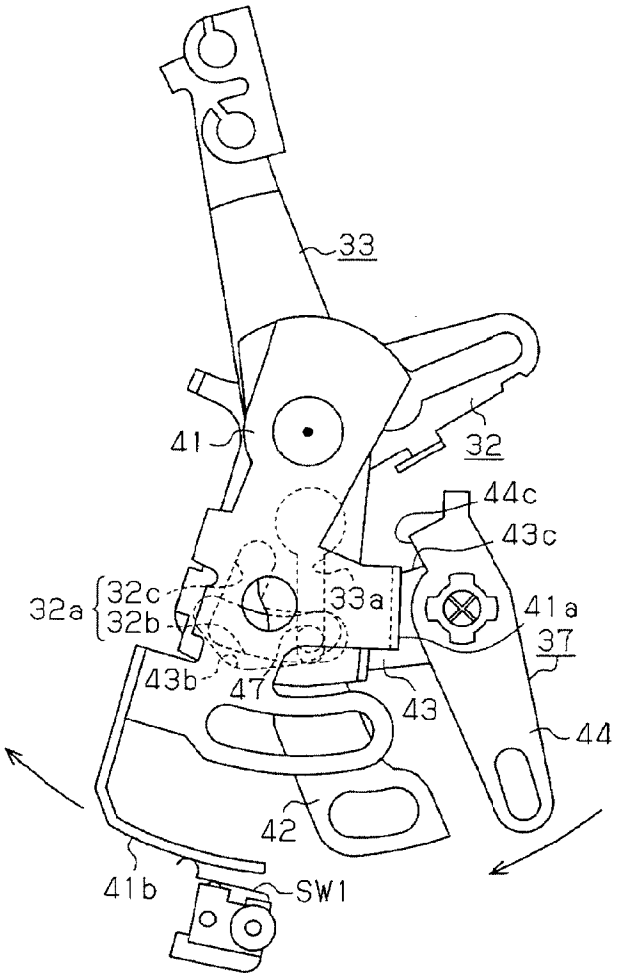
FIG. 9 is a diagram illustrating a state of the locking lever being rotated to the unlocked position in a case where and outside handle lever is actuated while the locking lever is at the lock position.

Normally, the first and second locking levers 43 and 44 are biased by the torque spring 55 so as to form the predetermined angle therebetween by which the engagement surface 43*c* contacts and engagement surface 44*c* (see FIG. 7). When the second locking lever 44 is rotated so as to resist against the biasing force generated by the torque spring 55, the second locking lever 44 is allowed to be rotatable relative to the first locking lever 43 in the clockwise direction in FIG. 7. Therefore, even if the rotation of the first locking lever 43 is restricted (not allowed) (see FIG. 9), the second locking lever 44 becomes rotatable relative to the first locking lever 43 in the manner where the second locking lever 44 is rotated so as to resist the biasing force of the torque spring 55 in response to the actuation of the locking actuator 17. More specifically, as illustrated in FIG. 9, even if the slide bush 47 protrudes and is engaged within the first elongated hole 32*b* of the open lever 32 in response to the rotation of the outside handle lever 41, the second locking lever 44 of the locking lever 37 is rotatable relative to the first locking lever 43 so as to resist the biasing force of the torque spring 55. Accordingly, the lock knob 53 is operated to unlock by the locking actuator 17 without being influenced by an operation state of the open lever 32 and the outside handle lever 41, which are linked to the first locking lever 43.

The inside lever 34 is rotatably supported by the rotary shaft 45 at a second end portion of the inside lever 34. Furthermore, the inside lever 34 is linked to the inside handle 4 at a first end portion of the inside lever 34 via a cable C5. The inside lever 34 is configured so as to be linkable with the lift lever 33 via the open lever 32. Therefore, when the inside handle 4 is operated in one direction (a first direction), an operation force inputted thereto is transmitted to the inside lever 34, thereby rotating the inside lever 34. Accordingly, the lift lever 33 is rotated together with the open lever 32, so that the front locking member 6 and the rear locking member 7, which retain the slide door 2 to be in the closed state, are unlocked in the above-described manner.

The fully-open-locked state releasing lever 36 is rotatably supported by the rotary shaft 45 at an intermediate portion of the fully-open-locked state releasing lever 36 in a longitudinal direction thereof. Furthermore, the fully-open-locked state releasing lever 36 is linked to the fully-opened state retaining member 8 at a first end portion via a cable C7. On the other hand, a second end portion of the fully-open-locked state releasing lever 36 is linked to the inside handle 4 via a cable C6. The fully-open-locked state releasing lever 36 is rotatably actuated in response to an operation of the inside handle 4 in the other direction (i.e. a second direction, a direction opposite to the first direction). Accordingly, when the inside handle 4 is operated in the second direction, the operation force inputted to the inside handle 4 is transmitted to the fully-opened-state retaining member 8 via the cable C7, thereby unlocking the fully-opened-state retaining member 8, which retains the slide door 2 to be in the fully-opened state.

A torque spring 60, whose first end portion is engaged with the open lever 32 and whose second end portion is engaged with the rotary shaft 45, is wounded around the rotary shaft 45. A tension spring 61 is provided between the fully-open-locked state releasing lever 36 and the base bracket 31. The fully-open-locked state releasing lever 36 is rotated in a counterclockwise direction in FIG. 4 by a biasing force of the tension spring 61, so that the fully-open-locked state releasing lever 36 is normally positioned at an initial position illustrated in FIG. 4. Furthermore, the outside handle lever 41 and the open lever 32 are positioned at an initial position in a state where the engagement flange 41 a contacts the engagement flange 32*d*, as illustrated in FIG. 6. Similarly, the release lever 42 and the lift lever 33 are positioned at an initial position in a state where the engagement flange 42*a* contacts the engagement flange 33*b*, as illustrated in FIG. 6.

As illustrated in FIG. 4, a power slide door switch SW1, which will be hereinafter referred to as a PSD switch SW1, is provided on the base bracket 41. The PSD switch SW1, which serves as a detection switch for detecting a rotational operation of the outside handle lever 41, is configured so as to be switched from an OFF state to an ON state when the outside handle lever 41 is rotated from the initial position in the clockwise direction and the switch contact piece 41 b contacts the PSD switch SW1 (see FIG. 7). Therefore, the PSD switch SW1 is arranged on a rotation trajectory of the switch contact piece 41 b (i.e. the outside handle lever 41). Therefore, for example, the rotation of the outside handle lever 41 in response to the rotational operation of the outside handle 3 while the slide door 2 is in the locked state is detected by the PSD switch SW1. In other words, the PSD switch SW1 detects the rotational operation of the outside handle 3 as an intention of the user that intends to release the retention of the slide door 2 in the closed state by means of the front locking member 6 and the rear locking member 7.

An open switch SW2 is provided on the base bracket 31. The open switch SW2 is configured so as to be switched from an OFF state to an ON state when the open lever 32 is rotated from the initial position in the clockwise direction together with the outside handle lever 41 and a switch contact piece 32*e*, which is formed on the open lever 32, contacts the open switch SW2. Therefore, for example, the rotation of the open lever 32, which is rotated together with the outside handle lever 41, in response to the rotational operation of the outside handle 3 while the slide door 2 is in the unlocked state is detected by the open switch SW2. In other words, the open switch SW2 detects the rotational operation of the outside handle 3 as an intention of the user that intends to release the retention of the slide door 2 in the closed state by means of the front locking member 6 and the rear locking member 7 while the slide door 2 is in the unlocked state and to open the slide door 2.

Furthermore, the PSD switch SW1 and the open switch SW2 are arranged so that, when the outside handle 3 is rotationally operated, the switch contact piece 41*b* of the outside handle lever 41 contacts the PSD switch SW1 first, and then, the switch contact piece 32*e* of the open lever 32 contacts the open switch SW2.

A close switch SW3 is provided on the base bracket 31. The close switch SW3 is configured so as to be switched from an OFF state to an ON state when the fully-open-locked state releasing lever 36 is rotated from the initial position in the clockwise direction and a switch contact piece 36*a*, which is formed on the fully-opened-state retaining lever 36, contacts the close switch SW3. Therefore, for example, the rotation of the fully-open-locked state releasing lever 36 in response to the operation to the inside handle 4 while the slide door 2 is in the fully-opened state is detected by the close switch SW3. In other words, the close switch SW3 detects the operation of the inside handle 4 as an intention of the user that intends to release the retention of the slide door 2 in the fully opened state by means of the fully-opened-state retaining member 8 and to close the slide door 2.

As illustrated in FIG. 5, the rear locking member 7 includes a half-latch switch SW4 for detecting a rotational position of the latch 11 to be positioned while the slide door 2 is partially-closed state and a full-latch switch SW5 (a full-latch detecting switch) for detecting a rotational position of the latch 11 to be positioned while the slide door 2 is in the fully-closed state. Furthermore, the rear locking member 7 includes a pawl switch SW6, which is configured so as to be switched from an OFF state to an ON state when the pawl 12 is rotated from an initial position at which the pawl 12 prevents the latch 11 from rotating and a lever 14 rotated together with the pawl 12 contacts the pawl switch SW6.

Figure 10:
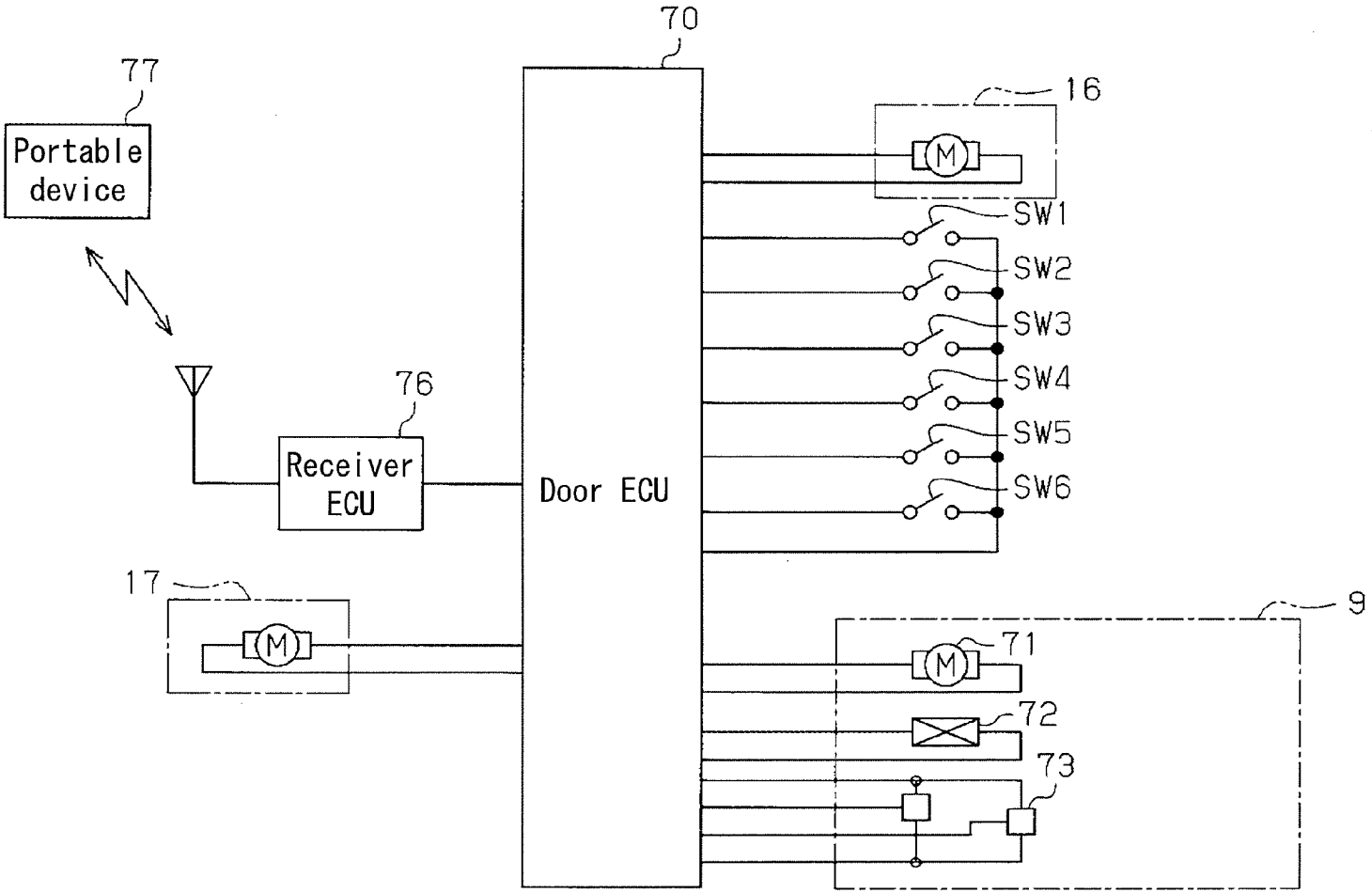
FIG. 10 is a diagram illustrating an electrical configuration of the door opening and closing apparatus according to the embodiment.

An electric configuration of the door opening and closing apparatus for the vehicle (the electronic key system) will be described below with reference to FIG. 10. As illustrated in FIG. 10, a door electronic control unit 70, which will be hereinafter referred to as a door ECU 70 and which is provided at the vehicle body 1 or the slide door 2, is configured with, for example, a microcontroller (MCU) as a core. Furthermore, the door ECU 70 is electrically connected to the power slide door apparatus 9. The power slide door apparatus 9 includes a direct current motor 71, which is hereinafter referred to as a DC motor 71, an electromagnetic clutch 72 and a pulse sensor 73. The door ECU 70 is configured so as to control an actuation of the DC motor 71 in order to control the slide door 2 to be opened and closed. Furthermore, the door ECU 70 is configured so as to control an actuation of the electromagnetic clutch 72 in order to establish and interrupt a power transmission between the DC motor 71 and the slide door 2. More specifically, the door ECU 70 establishes the power transmission between the DC motor 71 and the slide door 2 only in a case where the slide door 2 is operated to be electrically opened and closed. On the other hand, in a case where the slide door 2 is operated to be manually opened and closed, the door ECU 70 interrupts the power transmission between the DC motor 71 and the slide door 2. Accordingly, the slide door 2 is smoothly operated to be opened and closed in any case where the slide door 2 is electrically operated or manually operated. Still further, the door ECU 70 is configured so as to detect a rotational direction (a positive rotation or a negative rotation that is inverse to the positive rotation), a rotation (a rotational amount) and a rotational speed of the DC motor 71, in other words, a position of the slide door 2 (an opened position, a closed position) and an opening and closing speed of the slide door 2 on the basis of a pair of pulse signals, whose phases differ from each other, outputted from the pulse sensor 73. Then, the door ECU 70 controls the actuation of the DC motor 71 so as to open and close the slide door 2 on the basis of the pulse signals outputted from the pulse sensor 73.

The door ECU 70 is electrically connected to each of the release actuator 16, the PSD switch SW1, the open switch SW2, the close switch SW3, the half-latch switch SW4, the full-latch switch SW5 and the pawl switch SW6. Accordingly, for example, the door ECU 70 is configured so as to control the actuation of the release actuator 16 on the basis of a detection signal outputted from each of the PSD switch SW1, the open switch SW2, the close switch SW3, the half-latch switch SW4, the full-latch switch SW5 and the pawl switch SW6.

Still further, the door ECU 70 is electrically connected to a receiver ECU 76, which is provided on the vehicle body 1. The receiver ECU 76 configures a wireless communication system between the receiver ECU 76 and a portable device 77, which is carried by the user. More specifically, the receiver ECU 76 recognizes that the user (the authorized user) is approaching the vehicle when an identification signal (an ID signal) outputted from the portable device, which is carried by the user, is authenticated while the user is within a predetermined area relative to the vehicle, which is locked. Then, the receiver ECU 76 outputs the authentication result to the door ECU 70. The door ECU 70 controls the actuation of the release actuator 16 in order to release (unlock) the retention of the slide door 2 in the closed state by means of the front locking member 6 and the rear locking member 7 when, for example, the rotational operation of the outside handle 3 is detected by the PSD switch SW1 under the condition that the receiver ECU 76 recognizes that the authorized user is approaching the vehicle while the slide door 2 is in the locked state.

Additionally, the door ECU 70 controls the actuation of the locking actuator 17 at the same time (or after) the front locking member 6 and the rear locking member 7 are unlocked, in order to rotate the first locking lever 43, which is positioned at the lock position, to the unlock position. The aforementioned control is executed in order to avoid a theoretical antinomy that the slide door 2 is in the locked state even if the slide door 2 is in the opened state. Then, the door ECU 70 controls an actuation of the power slide door apparatus 9 (i.e. the DC motor 71 and the like) in order to open the slide door 2 when the retention of the slide door 2 in the closed state by means of the front locking member 6 and the rear locking member 7 is released (unlocked).

Figure 11:
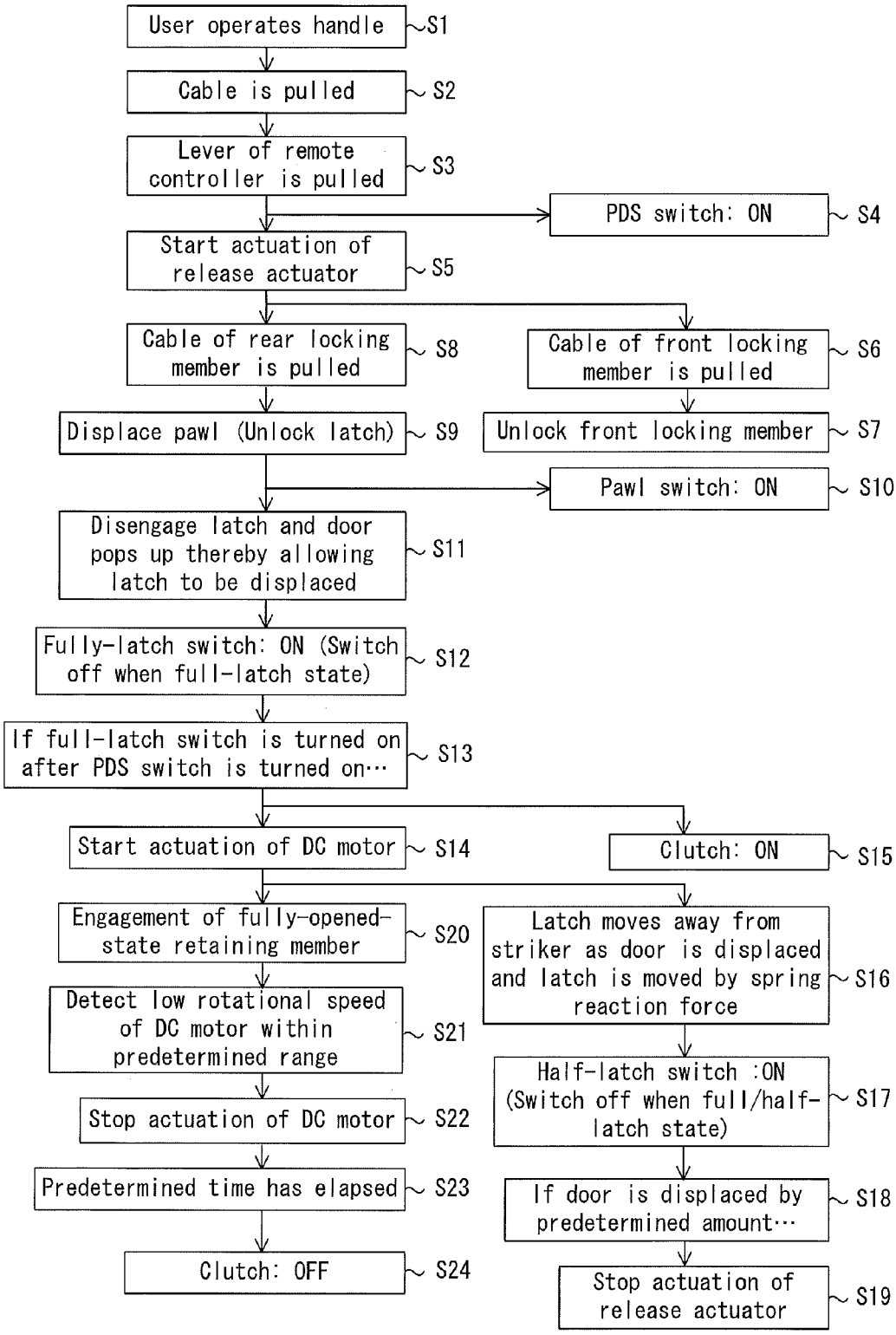
FIG. 11 is a flowchart illustrating an opening control of the vehicle door according to the embodiment.

An opening operation of the slide door 2 according to the embodiment will be described below with reference to a flowchart illustrated in FIG. 11. The opening operation of the slide door 2 will be explained below based on an assumption that the receiver ECU 76 recognizes that the authorized user is approaching the vehicle, which is in the locked state (see FIG. 6). Therefore, an operation performed by the user and a processing executed by the door ECU 70 accordingly are both described in the flowchart of FIG. 11.

When the user rotationally operates the outside handle 3 (step S1), the cable C3 is pull accordingly (step S2), therefore, the outside handle lever 41 of the remote controller 5 is pulled (step S3, see FIG. 7). Accordingly, the PSD switch SW is switched from the OFF state to the ON state (step S4). Then, the actuation of the release actuator 16 is started in order to release the retention of the slide door 2 in the closed state by means of the front locking member 6 and the rear locking member 7 (step S5). Simultaneously, the locking actuator 17 is actuated in order to unlock the lock knob 53 (see FIG. 8).

Accordingly, the cable C1 of the front locking member 6 is pulled (step S6), thereby unlocking the front locking member 6 (step S7). Simultaneously, the cable C2 of the rear locking member 7 is pulled (step S8), so that the pawl 12 is rotated together with the lever 14 and the rear locking member 7 is unlocked (step S9). Accordingly, the pawl switch SW6 is switched from the OFF state to the ON state in response to the rotation of the pawl 12 (step S10). Then, when the latch 11 is released from the pawl 12, so that the larch 11 is allowed to be rotated (step S11), thereby popping up the slide door 2. As a result, the full-latch switch SW5 is switched from the OFF state to the ON state (step S12).

After the PSD switch SW 1 is switched to the ON state, the actuation of the DC motor 71 of the power slide door apparatus 9 is started in order to open the slide door 2 (step S14) upon the assumption that the full-latch switch SW5 is switched to the ON state (step S13), and then, the electromagnetic clutch 72 is turned on (i.e. the electromagnetic clutch 72 is turned to be in an engaged state) (step S15). Additionally, the processes in step S14 and step S15 are executed, for example, even if the PSD switch SW1 is once switched to the ON state and then switched to the OFF state, but then the full-latch switch SW5 is turned on thereafter in step S13.

After the actuation of the DC switch 71 is started, the latch 11 is displaced away from the striker 13 in response to the displacement of the slide door 2, which allows the latch 11 to be further rotated (step S16), the half-latch switch SW4 is switched from the OFF state to the ON state (step S17). Then, when the door ECU 70 detects that the slide door 2 is displaced (opened) by a predetermined distance (a predetermined amount) on the basis of the detection result of the pulse sensor 73 (step S18), the actuation of the release actuator 16 is stopped (step S19). A reason for stopping the actuation of the release actuator 16 upon the displacement of the slide door 2 by the predetermined distance (the predetermined amount) is to avoid the latch 11, which is once unlocked, from engaging with the striker 13 once again.

When the fully-opened state retaining member 8 is engaged with the vehicle body 1 in response to the displacement of the slide door 2 after the actuation of the DC motor 71 is started (step S20), a low rotational speed in a predetermined range of the DC motor 71 is detected (is expected to be detected) by the pulse sensor 73 (step S21). Accordingly, the door ECU 70 assumes that the slide door 2 reaches a fully-opened position and stops the actuation of the DC motor 71 (step S22). Then, after a predetermined time has elapsed (step S23), the electromagnetic clutch 72 is turned off (i.e. the electromagnetic clutch 72 is turned to be in a disengaged state) (step S24). A reason for turning off the electromagnetic clutch 72 after the predetermined time has elapsed is, for example, to avoid the slide door 2 from being displaced while the vehicle is on an inclined road or the like.

Figure 12:
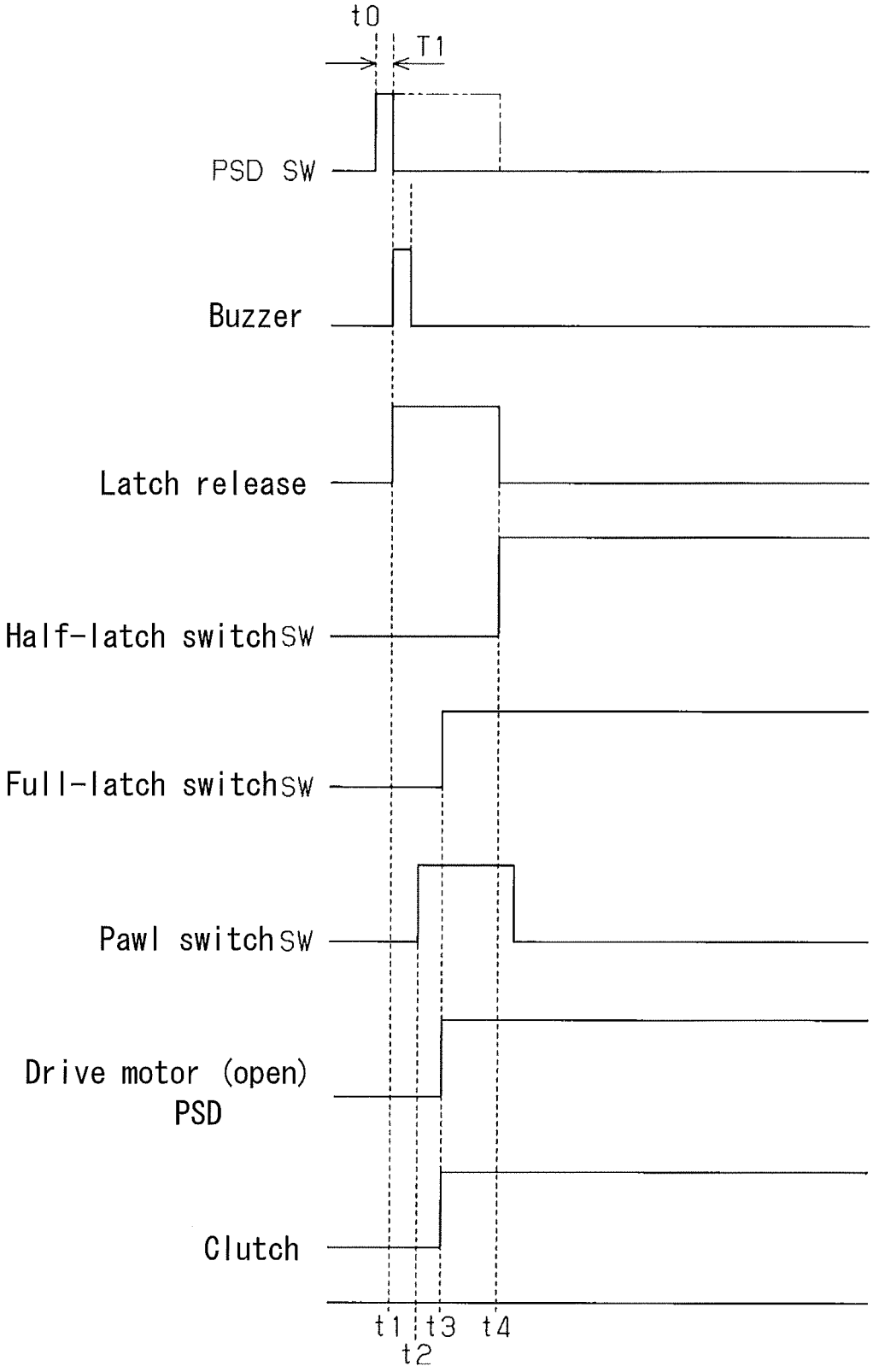
FIG. 12 is a timing chart illustrating a timing of the opening control of the vehicle door according to the embodiment.

A timing of the opening operation of the slide door 2 according to the embodiment will be explained below with reference to a timing chart of FIG. 12. As illustrated in FIG. 12, when the PSD switch SW 1 is turned to the ON state from the OFF state at a time t0 in response to the rotational operation to the outside handle 3 by the user, a buzzer and the like is actuated at a time t1 after a predetermined time T1 has elapsed, and simultaneously, the actuation of the release actuator 16 is started. Accordingly, the pawl switch SW6 is turned to the ON state from the OFF state at a time t2 and further, the full-latch switch SW5 is turned to the ON state from the OFF state at a time t3, so that the actuation of the DC motor 71 of the power slide door apparatus 9 is started and the electromagnetic clutch 72 is turned on. Then, when the latch 11 is displaced away from the striker 13 in response to the displacement of the slide door 2 and the latch 11 is further rotated, the half-latch switch SW4 is turned to the ON state from the OFF state at a time t4. Accordingly, the actuation of the release actuator 16 is stopped. As indicated by a solid line indicating a control timing of the PSD switch SW1 in the timing chart of FIG. 12, even if the PSD switch SW1 is turned to the OFF state after the PSD switch SW1 is once turned to the ON state, but the full-latch switch SW5 is turned to the ON state thereafter, the actuation of the DC motor 71 of the power slide door apparatus 9 is started in order to open the slide door 2. Additionally, as indicated by a chain double-dashed line indicating the control timing of the PSD switch SW1, the actuation of the DC motor 71 of the power slide door apparatus 9 is started in order to open the slide door 2 in a case where the full-latch switch SW5 is turned to the ON state while the PSD switch SW1 is in the ON state. In other words, the PSD switch SW1 serves as a trigger to release the latch 11, and the full-latch switch SW5 serves as a trigger to actuate the DC motor 71 of the power slide door apparatus 9.

An overview of the opening operation (an opening control) of the slide door based on an assumption that the slide door 2 is in the unlocked state will be described below. In this case, when the user rotationally operates the outside handle 3, the cable C3 is pulled, thereby pulling the outside handle lever 41 of the remote controller 5. Accordingly, the open switch SW2 is switched from the OFF state to the ON state. Then, the cable C1 of the front locking member 6 is pulled, therefore, the front locking member 6 is unlocked. Simultaneously, the cable C2 of the rear locking member 7 is pulled, and the pawl 12 is rotated together with the lever 14, thereby unlocking the rear locking member 7. In this case, the pawl switch SW6 is switched from the OFF state to the ON state in response to the rotational movement of the pawl 12. Then, when the latch 11 is released, the latch 11 is allowed to be rotated, so that the slide door 2 is popped up. Accordingly, the full-latch switch SW5 is switched from the OFF state to the ON state.

Then, based on the assumption that all of the open switch SW2, the full-latch switch SW5 and the pawl switch SW6 are turned on, the electromagnetic clutch 72 is turned on and the DC motor 71 of the power slide door apparatus 9 is actuated in order to open the slide door 2.

After the DC motor 71 is actuated, the latch 11 is moved away from the striker 13 in response to the displacement of the slide door 2, so that the latch 11 is allowed to be further rotated. The operation of the slide door 2 after the latch 11 is further rotated is as described above (see steps S16 to S24).

In this embodiment, the actuation of the release actuator 16 and the like are started upon the rotational operation to the outside handle 3 while the slide door 2 is in the locked state. Therefore, as illustrated in FIG. 7, the open lever 32 is rotated together with the outside handle lever 41 in the clockwise direction in FIG. 7 before the lock knob 53 is unlocked by the locking actuator 17. More specifically, in this case, the open lever 32 is rotated so as to guide the slide bush 47 along the first elongated hole 32*b* of the open lever 32 until the slide bush 47 is positioned at an end portion of the first elongated hole 32*b* (i.e. at the end portion of the first elongated hole 32*b* positioned at the right in FIG. 7), so that the first locking lever 43 is not allowed to be rotated to the unlock position. However, as illustrated in FIG. 9, when the second locking lever 44 is rotated in the clockwise direction in FIG. 9 relative to the first locking lever 43 so as to resist the biasing force generated by the torque spring 55 in response to the actuation of the locking actuator 17, the lock knob 53 is allowed to be operated to be unlocked. As described previously, the front locking member 6 and the rear locking member 7 are configured so as to be unlocked in response to the operation of the release lever 42 independently of the outside handle lever 41.

As described above, following advantages and merits are considered to be achieved according to the embodiment. Firstly, according to the embodiment, the rotational operation to the outside handle 3 is detected by the PSD switch SW1 as the intention of the user that intends to release the retention of the slide door 2 in the closed state by the front locking member 6 and the rear locking member 7. Then, when the rotational operation to the outside handle 3 is detected by the PSD switch SW1 while the slide door 2 is in the locked state, the front locking member 6 and the rear locking member 7 are actuated by the release actuator 16, so that the retention of the slide door 2 in the closed state is released (unlocked). In this case, because the door opening and closing apparatus is configured so that the operation of the outside handle lever 41 (the outside lever 35), which is supported within the space S2 formed inside of the slide door 2 so as to be positioned closer to the interior of the vehicle, is detected by the PSD switch SW1 as the rotational operation to the outside handle 3, the PSD switch SW1 is also allowed to be provided within the space S2. Accordingly, a water resistance of the PSD switch SW1 may be enhanced. Furthermore, because the PSD switch SW1 does not need to be provided, for example, within a limited space formed inside of the outside handle 3, arrangement flexibility (flexibility in an arrangement) of the PSD switch SW1 may be increased.

Secondly, according to the embodiment, while the slide door 2 is in the unlocked state, the operation of the outside handle lever 41 (the outside lever 35) in response to the operation to the outside handle 3 is allowed to be transmitted to the front locking member 6 and the rear locking member 7 by the locking lever 37, so that the retention of the slide door 2 in the closed state in the front locking member 6 and the rear locking member 7 is released (unlocked). Furthermore, because the operation of the outside handle lever 41 (the outside lever 35) in response to the operation to the outside handle 3 is not transmitted to the front locking member 6 and the rear locking member 7 by the locking lever 37 while the slide door 2 is in the locked state, the retention of the slide door 2 in the closed state by the front locking member 6 and the rear locking member 7 is not releasable. On the other hand, because the release lever 42 (the outside lever 35) is linked to the release actuator 16, a force generated by the release actuator 16 is transmitted to the front locking member 6 and the rear locking member 7 without being influenced by the locked/unlocked state of the slide door 2, so that the retention of the slide door 2 in the closed state by the front locking member 6 and the rear locking member 7 is released. As described above, release (unlocking) of the retention of the slide door 2 in the closed state by the front locking member 6 and the rear locking member 7 may be achieved by the operation to the outside handle 3 while the slide door 2 is in the unlocked state, with a simple configuration of the outside lever 35, which includes the outside handle lever 41 and the release lever 42. Alternatively, the retention of the slide door 2 in the closed state by the front locking member 6 and the rear locking member 7 may be released by using he force generated by the release actuator 16 while the slide door 2 is in the locked state.

Thirdly, according to the embodiment, because the force generated by the release actuator 16 is distributed and transmitted to the front locking member 6 and the rear locking member 7 (plural latch mechanisms) by the lift lever 33, a power transmission configuration (a power transmission pathway) may be simplified when comparing to a case where, for example, the force generated by the release actuator 16 is independently and separately transmitted to the front locking member 6 and the rear locking member 7.

Fourthly, according to the embodiment, because the PSD switch SW1 is actuated (i.e. turned on) in response to the rotational movement of the outside handle lever 41 (the switch contact piece 41 b), in other words, in response to the actual operation to the outside handle 3, the actuation of the PSD switch SW1 by a false (inappropriate) operation may be avoided. Furthermore, an actuation timing of the PSD switch SW1 may be easily adjusted by adjusting a contacting timing between the switch contact piece 41 b and the PDS switch SW1.

Fifthly and finally, according to the embodiment, the PSD switch SW1 is configured so as to be actuated in response to the rotational movement of the outside handle lever 41 (the switch contact piece 41 b), in other words, in response to the actual operation to the outside handle lever 3. Therefore, when the user carrying the portable device 77 is approaching to the vehicle within the predetermined area while the slide door 2 is in the locked state, and the ID signal outputted from the portable device 77 is authenticated, so that the door opening and closing apparatus recognizes that the user (the authorized user) is approaching to the vehicle while a passenger remains within the vehicle, an inappropriate operation that the slide door 2 is opened when the passenger within the vehicle operates the inside handle door 4 may be avoided.

An example of a detailed assembling of the locking lever 37 according to the embodiment will be described below with reference to the attached drawings.

As illustrated in FIGS. 14A, 14B, 14C and 14D, an engagement bore 44*d* (a first engagement recessed portion), which penetrates the shaft portion 44*a* at a circumferential portion thereof in the thickness direction, is formed at the second locking lever 44 of the locking lever 37. The torque spring 55 includes a coil portion 55*a*, which is wound around the shaft portion 44*a*. A first end portion 55*b* of the coil portion 55*a* (the torque spring 55) is inserted into the engagement bore 44*d* so as to be engaged therewith.

Figure 13A:
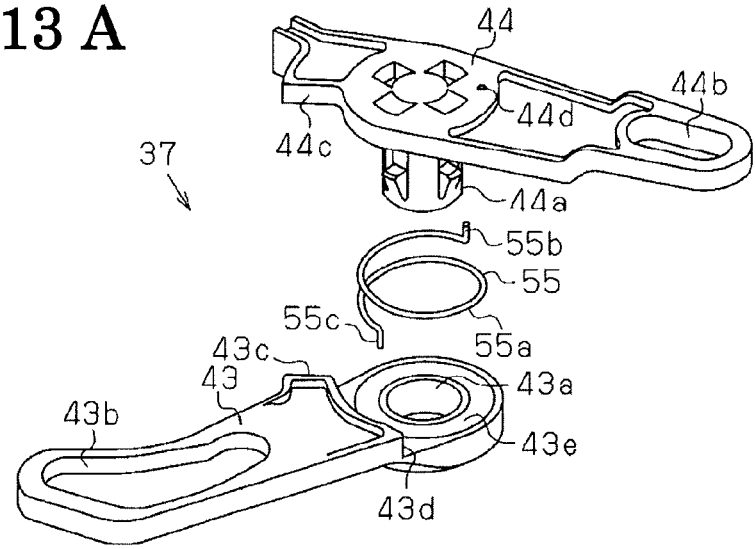
FIG. 13A is an exploded view of the locking lever of a door opening and closing apparatus for a vehicle according to the embodiments.
Figure 13B:
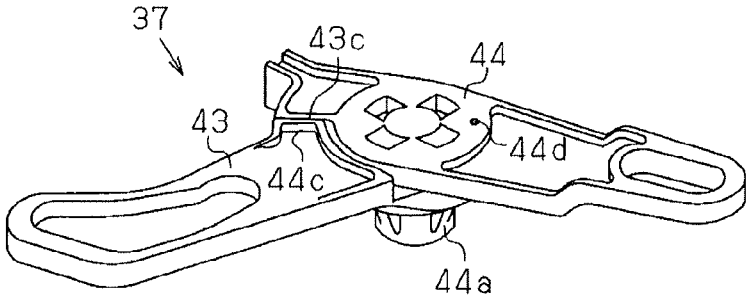
FIG. 13B is a perspective view of the locking lever of the door opening and closing apparatus for the vehicle according to the embodiment when being assembled.
Figure 13C:
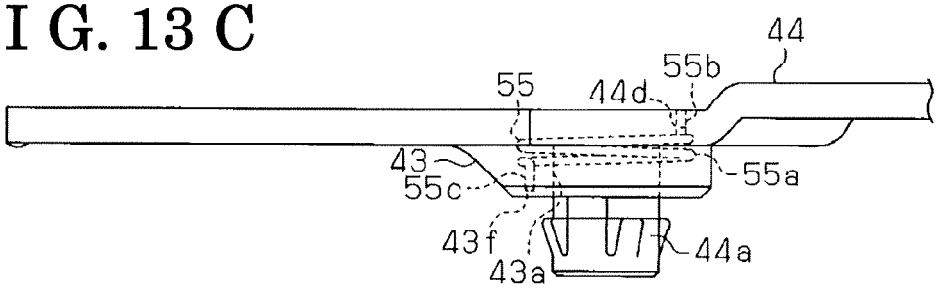
FIG. 13C is a side view of the assembled locking lever of the door opening and closing apparatus for the vehicle according to the embodiment.

A stepped portion 43*d* is formed at the first locking lever 43 so that a peripheral portion of the bearing hole 43*a* is positioned away from the second locking lever 44 in the thickness direction when comparing to the elongated hole 43*b*. In other words, the stepped portion 43*d* is formed at the first locking lever 43 so that a portion where the bearing hole 43*a* is positioned so as to be displaced from a portion where the elongated hole 43*b* in the thickness direction of the first locking lever 43. The stepped portion 43*d* forms a slide surface against which the second locking lever 44 slides, so that the second locking lever 44 slidably rotates relative to the first locking lever 43. Furthermore, an accommodation recessed portion 43*e*, which is formed in a substantially annular shape, for accommodating therein the coil portion 55*a* is formed on the first locking lever 43 so as to be positioned radially outwardly of the bearing hole 43*a*. An engagement recessed portion 43*f* (a second engagement recessed portion) is formed on the accommodation recessed portion 43*e* so as to extend from a portion of the accommodation recessed portion 43*e* in the thickness direction (see FIG. 13C). A second end portion 55*c* of the torque spring 55 is inserted into and engaged with the engagement recessed portion 43*f*. Additionally, a guide surface 43*g* (see FIG. 15), which is formed to incline and to guide the second end portion 55*c* of the torque spring 55 to be fitted into the engagement recessed portion 43*f* is formed at the engagement recessed portion 43*f*.

Figure 14A:
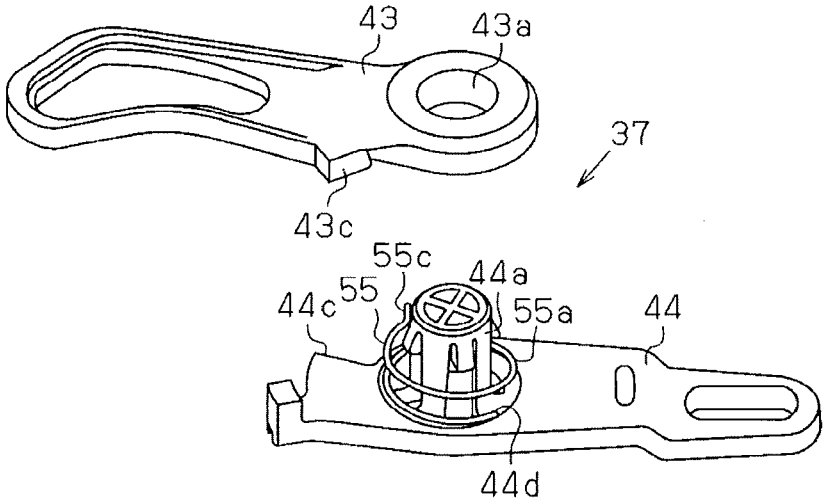
FIGS. 14A, 14B, 14C and 14D are diagrams for explaining an assembling of the locking lever of the door opening and closing apparatus for the vehicle according to the embodiment.
Figure 14B:
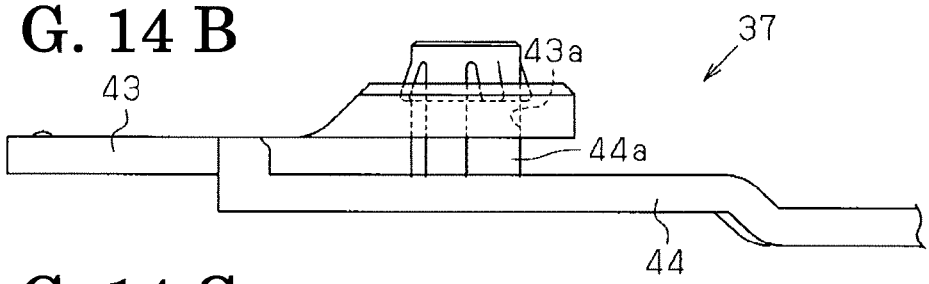
Figure 14C:
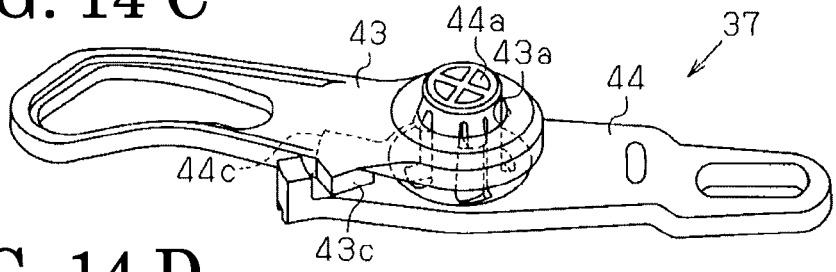
Figure 14D:
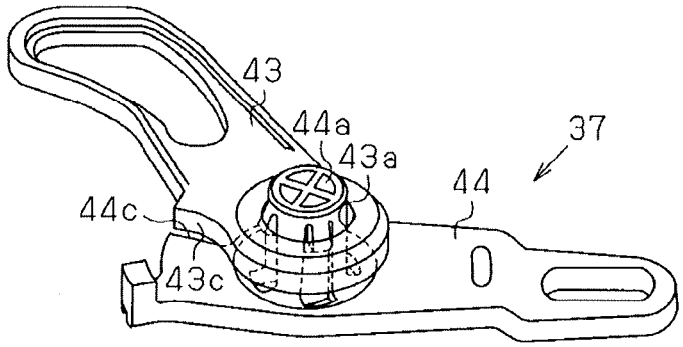

The assembling of the locking lever 37 will be described below in detail. As illustrated in FIG. 14A, the first end portion 55*b* of the torque spring 55 is inserted into and engaged with the engagement bore 44*d* of the second locking lever 44 in a state where the coil portion 55*a* of the torque spring 55 is preliminarily wound around the shaft portion 44*a*. In this case, the biasing force of the torque spring 55 is released (i.e. the torque spring 55 is in a free state). While the above-state is established, the shaft portion 44*a* is inserted into the bearing hole 43*a* while the first and second locking levers 43 and 44 are at an angular position so that the first an second locking levers 43 and 44 are aligned, in order to place the first locking lever 43 on the second locking lever 44 in the thickness direction thereof. Accordingly, the second end portion 55*c* of the coil spring 55 elastically contacts the accommodation recessed portion 43*e*, so that the coil portion 55*a* of the torque spring 55 is accommodated within the accommodation recessed portion 43*e* in a state where the coil portion 55*a* is compressed in the axial direction. In this case, the torque spring 55 generates the biasing force only in the axial direction and the biasing force (the torque) in a circumferential direction of the torque spring 55 is not generated.

Figure 15:
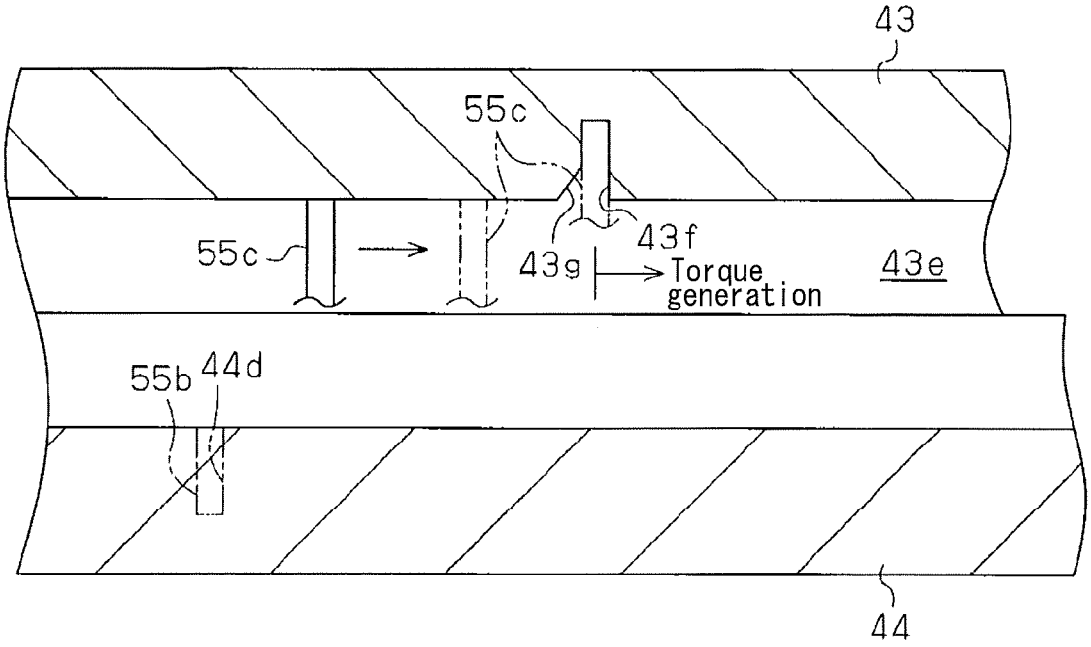
FIG. 15 is a diagram for explaining an assembling of a torque spring to the locking lever.

While the above-described temporal assembling is achieved, the first and second locking levers 43 and 44 are rotated relative to each other so as to form a predetermined angle by which the engagement surface 43*c* engages with the engagement surface 44*c*. Accordingly, as illustrated in FIG. 15 where an outer circumferential surface of the shaft portion 44*a* (the accommodation recessed portion 43*e*) is linearly developed, the torque spring 55, whose first end portion 55*b* is engaged with the second locking lever 44, is rotated relative to the first locking lever 43 and the second end portion 55*c* of the torque spring 55 slidably moves within the accommodation recessed portion 43*e*. Accordingly, when the second end portion 55*c* of the torque spring 55 reaches the engagement recessed portion 43*f*, the second end portion 55*c* of the torque spring 55 is guided by the guide surface 43*g* so as to be fitted into and engaged with the engagement recessed portion 43*f*.

When the first and second locking levers 43 and 44 are further rotated relative to each other until the first and second locking levers 43 and 44 form a predetermined angle, by which the engagement surface 43*c* engages with the engagement surface 44*c* (see FIG. 14D), while the above-described state is established, the biasing force is generated by the torque spring 55 in the circumferential direction thereof. In this case, because the first and second locking levers 43 and 44 form the predetermined angle by which the engagement surface 43*c* engages with the engagement surface 44*c*, the engagement surface 43*c* and the engagement surface 44*c* engage with each other while the torque spring 55 generates a necessary torque (an initial torque) (see FIG. 13B) when the shaft portion 44*a* is further inserted into the bearing hole 43*a*. Accordingly, the first and second locking levers 43 and 44 are retained at the initial position by the torque spring 55, thereby completing the assembling of the locking lever 37.

As described above, according to the assembling example of the locking lever 37, following advantages and merits may be achieved. Firstly, the first end portion 55*b* of the torque spring 55 is engaged with the engagement bore 44*d* in the state where the coil portion 55*a* is wound around the shaft portion 44*a* upon the assembling of the torque spring 55. Then, the first and second locking levers 43 and 44 are placed on each other in the state where the shaft portion 44*a* is inserted into the bearing hole 43*a*, and the first and second locking levers 43 and 44 are rotated relative to each other, so that the second end portion 55*c* of the torque spring 55 slidably moving within the accommodation recessed portion 43*e* is fitted into and engaged with the engagement recessed portion 43*f*. The first and second locking levers 43 and 44 are further rotated relative to each other until the first and second locking levers 43 and 44 form the predetermined angle in the state where the second end portion 55*c* of the torque spring 55 is engaged with the engagement recessed portion 43*f*. Accordingly, the torque spring 55 generates the biasing force. The shaft portion 44*a* is further inserted into the bearing hole 43*a* in the state where the first and second locking levers 43 and 44 form the predetermined angle, so that the first and second locking levers 43 and 44 engage with each other so as to form the predetermined angle, at which the first and second locking levers 43 and 44 are positioned at the initial position. Accordingly, the assembling of the first and second locking levers 43 and 44 may be enhanced (i.e. the locking lever 37 may be easily assembled).

Secondly, the second end portion 55*c* of the torque spring 55 may be smoothly inserted into and engaged with the engagement recessed portion 43*f* by the guide surface 43*g*. Thirdly, the locking lever 37, whose size is further reduced when comparing to a known locking lever, may have more flexibility in arrangement at (more flexibly provided at) the remote controller 5, which has a limited accommodation space therewithin.

Fourthly, the initial torque may be ensured only by relatively rotating the first and second locking levers 43 and 44 to the respective initial positions and deforming (stroking) the coil portion 55*a* of the torque spring 55 in the circumferential direction. Therefore, the initial torque may be easily adjusted only by adjusting a deformation (a deformation amount) of the coil portion 55*a* in the circumferential direction.

Additionally, the above-described door opening and closing apparatus according to the embodiment may be modified as described below. The door opening and closing apparatus according to the embodiment may be modified so that the outside lever 35 is configured as one component in which the outside handle lever 41 and the release lever 42 are integrally formed. In this case, the outside lever integrally including the outside handle lever 41 and the release lever 42 is configured so as to be linked to the release actuator 16 and to be also linkable to the front locking member 6 and the rear locking member 7 via the locking lever 37. In this case, while the slide door 2 is in the unlocked state, the operation of the outside lever in response to the operation to the outside handle 3 is allowed to be transmitted to the front locking member 6 and the rear locking member 7 via the locking lever 37, so that the retention of the slide door 2 in the closed state by the front locking member 6 and the rear locking member 7 is released (unlocked). On the other hand, while the slide door 2 is in the locked state, the transmission of the operation of the outside lever integrally including the outside handle lever 41 and the release lever 42 in response to the operation to the outside handle 3 to the front locking member 6 and the rear locking member 7 is interrupted by the locking lever 37, so that the retention of the slide door 2 in the closed state by the front locking member 6 and the rear locking member 7 is not releasable. In this case, when the locking lever 37 is actuated by the locking actuator 17 so as to switch the state of the slide door 2 from the locked state to the unlocked state, the retention of the slide door 2 in the closed state by the front locking member 6 and the rear locking member 7 may become releasable.

As described above, while the slide door 2 is in the locked state, when the PSD switch SW1 is actuated in response to the actual operation to the outside handle 3, the locking lever 37 is actuated by the locking actuator 17 so as to switch the state of the slide door 2 from the locked state to the unlocked state. Then, after the displacement of the locking lever 37 to the unlock position is completed (e.g., completion of the displacement of the locking lever 37 may be detected by means of a switch or the release actuator 16 is configured so as to actuate after a predetermined time for displacing the locking lever 37 from the lock position to the unlock position is elapsed), the operation of the outside lever integrally including the outside handle lever 41 and the release lever 42 in response to the force generated by the release actuator 16 is transmitted to the front locking member 6 and the rear locking member 7. Accordingly, the retention of the slide door 2 in the closed state by the front locking member 6 and the rear locking member 7 may be released. As described above, while the slide door 2 is in the locked state, the locking lever 37 is actuated by the locking actuator 17 in order to switch the state of the slide door 2 from the locked state to the unlocked state. Accordingly, the retention of the slide door 2 in the closed state by the front locking member 6 and the rear locking member 7 may be released by the rotational operation to the outside handle 3 or the force generated by the release actuator 16.

According to the above-described embodiment, a number of the latch mechanism may be changed so as to include any desired number of the latch mechanisms. For example, the front locking member 6 or the fully-opened-state retaining member 8 may be removed from the door opening and closing apparatus. Alternatively, the fully-opened-state retaining member 8 may be formed with a plate spring.

The power slide door apparatus 9 may be removed from the door opening and closing apparatus according to the embodiment. The door opening and closing apparatus according to the embodiment may be adapted to a swing-type vehicle door. Described below are technical ideas that may be drawn from the above-described embodiment and modification example.

The locking lever 37 is configured so as to be switched between the unlock state for allowing the operation force of the outside handle 3 to be transmitted to the latch mechanism (6, 7), which retains the slide door 2 to be in the closed state, and the locked state for not allowing the operation force of the outside handle 3 to be transmitted to the latch mechanism (6, 7). The locking lever 37 includes the first locking lever 43 having the bearing hole 43*a*, the second locking lever 44 having the shaft portion 44*a*, which is rotatable supported by the slide door 2 and which is rotatably supported by the bearing hole 43*a*, the torque spring 55 having the coil portion 55*a* wound around the shaft portion 44*a* and biasing the first and second locking levers 43 and 44 so as to from the predetermined angle by which the first and second locking levers 43 and 44 engage with each other, the engagement recessed portion 44*d* formed at the second locking lever 44 and engaging therewith the first end portion 55*b* of the torque spring 55, the accommodation recessed portion 43*e* formed at the first locking lever 43 so as to be positioned radially outwardly of the bearing hole 43*a* and accommodating therein the coil portion 55*a*, and the engagement recessed portion 43*f*, which is formed at the accommodation recessed portion and into which the second end portion 55*c* of the torque spring 55 slidably moving the accommodation recessed portion is inserted and fitted when the first and second locking levers 43 and 44, that are placed on each other in the state where the shaft portion 44*a* is inserted into the bearing hole 43*a*, are rotated relative to each other and which allows the torque spring 55 to generate the biasing force when the first and second locking levers 43 and 44 are further rotated relative to each other until forming the predetermined angle. The shaft portion 44*a* is further inserted into the bearing hole 43*a* while the first and second locking levers 43 and 44 form the predetermined angle, so that the first and second levers 43 and 44 engage with each other while forming the predetermined angle.

Generally, according to a known locking lever, which is configured with separate first and second locking levers, a torque spring, which is wound around a rotary shaft of each of the first and second locking levers, is adapted as a biasing means (a biasing device) for biasing the first and second locking levers so as to form a predetermined angle, by which the first and second locking levers engage with each other. For example, in a case where a tension spring is adapted, a space needs to be ensured around the locking lever in order to provide the tension spring. Therefore, in the known locking lever, the torque spring is adapted so as to be wound around the rotary shaft. However, the torque spring needs be provided around the rotary shaft between the first and second locking lever, which are place on each other so as to be rotatable relative to each other, and to generate a required (necessary) torque (a biasing force). Therefore, achieving both of ensuring the necessary torque and assembling the first and second locking lever may be difficult.

According to the assembling example of the locking lever 37, firstly, the first end portion 55*b* of the torque spring 55 is engaged with the engagement bore 44*d* in the state where the coil portion 55*a* is wound around the shaft portion 44*a* upon the assembling of the torque spring 55. Then, the first and second locking levers 43 and 44 are placed on each other in the state where the shaft portion 44*a* is inserted into the bearing hole 43*a*, and the first and second locking levers 43 and 44 are rotated relative to each other, so that the second end portion 55*c* of the torque spring 55 slidably moving within the accommodation recessed portion 43*e* is fitted into and engaged with the engagement recessed portion 43*f*. The first and second locking levers 43 and 44 are further rotated relative to each other until the first and second locking levers 43 and 44 form the predetermined angle in the state where the second end portion 55*c* of the torque spring 55 is engaged with the engagement recessed portion 43*f*. Accordingly, the torque spring 55 generates the biasing force. The shaft portion 44*a* is further inserted into the bearing hole 43*a* in the state where the first and second locking levers 43 and 44 form the predetermined angle, so that the first and second locking levers 43 and 44 engage with each other so as to form the predetermined angle, at which the first and second locking levers 43 and 44 are positioned at the initial position. Accordingly, the assembling of the first and second locking levers 43 and 44 may be enhanced (i.e. the locking lever 37 may be easily assembled).

According to the locking lever 37 configured as above, the locking lever 37 includes the guide surface 43*g*, which is formed at the engagement recessed portion 43*f* and which guides the second end portion 55*c* of the torque spring 55, which slidably moves within the accommodation recessed portion 43*e*, to be fittedly inserted into the engagement recessed portion 43*f*.

According to the door opening and closing apparatus having the above-described configuration, the second end portion 55*c* of the torque spring 55 may be smoothly fitted into and engaged with the engagement recessed portion 43*f* by the guide surface 43*g*. Furthermore, the locking lever 37 is provided within the remote controller 5 which is configured so as to distribute and transmit the operation force inputted from the outside handle 3 to the front locking member 6 and the rear locking member 7.

Accordingly, the locking lever 37, whose size is further reduced when comparing to the known locking lever, may have more flexibility in arrangement within the remote controller 5, which has the limited accommodation space therewithin. According to the embodiment and the modified example, the second locking lever 44 is linked to the locking actuator 17 so as to operate the lock knob 53 to be locked and unlocked. On the other hand, the first locking lever 43 is linked to the outside handle 3, and is linked to the open lever 32, which is further linked to the latch mechanisms (6, 7), while the slide door 2 is in the unlocked state.

Accordingly, the door opening and closing apparatus for the vehicle ensuring the water resistance and having a greater arrangement flexibility of the PSD switch SW1, which detects the intention of the user that intends to open the slide door 2, may be achieved.

According to the embodiment, the door opening and closing apparatus further includes the power slide door apparatus 9 adapted so as to operate the slide door 2 to be opened and closed, wherein each of the front locking member 6 and the rear locking member 7 includes the latch 11 adapted to retain the slide door 2 to be in a fully-closed state relative to the vehicle body 1 and the full-latch switch SW5 for detecting a rotational position of the latch 11 to be reached when the slide door 2 is in the fully-closed state. The release actuator 16 actuates the front locking member 6 and the rear locking member 7 in the case where the operation of the outside handle 3 is detected by the PSD switch SW1 while the slide door 2 is in the locked state. The power slide door apparatus 9 controls the slide door 2 to be opened in the case where the rotational position of the larch 11 to be reached when the slide door 2 is in the fully-closed state is not detected by the full-latch switch SW5 after the operation of the outside handle 3 is detected by the PSD switch SW1 while the slide door 2 is in the locked state.

Accordingly, the rotational operation to the outside handle 3 is detected by the PSD switch SW1 as the intension of the user that intends to release the retention of the slide door 2 in the closed state by the front locking member 6 and the rear locking member 7. Then, when the rotational operation to the outside handle 3 is detected by the PSD switch SW1 while the slide door 2 is in the locked state, the front locking member 6 and the rear locking member 7 is actuated by the release actuator 16, so that that the retention of the slide door 2 in the closed state is released. In this case, because the operation of the outside lever 35, which is supported within the space S2 formed within the slide door 2 positioned closer to the interior of the vehicle, is detected by the PSD switch SW1 as the rotational operation to the outside handle 3, the PSD switch SW1 may be provided within the space S2 formed within the slide door 2. Accordingly, the water resistance of the PSD switch SW1 may be enhanced. Furthermore, because the PSD switch SW1 does not need to be provided within the limited space formed inside of the outside handle 35, the PSD switch SW1 may have more flexibility in arrangement.

According to the embodiment, the door opening and closing apparatus further includes the locking lever 37, wherein the outside lever 35 includes the outside handle lever 41 linked to the outside handle 3 and linkable to the front locking member 6 and the rear locking member 7 and the release lever 42 linked to the release actuator 16 and configured so as to transmit the force generated by the release actuator 16 to the front locking member 6 and the rear locking member 7 in order to release the retention of the slide door 2 in the closed state by the front locking member 6 and the rear locking member 7, and wherein the locking lever 37 is configured so as to interrupt the transmission of the operation of the outside handle lever 41 to the front locking member 6 and the rear locking member 7 in order to turn the slide door 2 to be in the locked state and so as to allow the transmission of the operation of the outside handle lever 41 to the front locking member 6 and the rear locking member 7 in order to turn the slide door 2 to be in an unlocked state.

Accordingly, while the slide door 2 is in the unlocked state, the operation of the outside handle lever 41 (the outside lever 35) in response to the operation to the outside handle 3 is allowed to be transmitted to the front locking member 6 and the rear locking member 7 by the locking lever 37, so that the retention of the slide door 2 in the closed state by the front locking member 6 and the rear locking member 7 is released. On the other hand, while the slide door 2 is in the locked state, the transmission of the operation of the outside handle lever 41 (the outside lever 35) in response to the operation to the outside handle 3 to the front locking member 6 and the rear locking member 7 is interrupted by the locking lever 37, so that the retention of the slide door 2 in the closed state by the front locking member 6 and the rear locking member 7 is not releasable. The release lever 42 (the outside lever 35) is linked to the release actuator 16, therefore, the force generated by the release actuator 16 is transmitted to the front locking member 6 and the rear locking member 7 without being influenced by the locking or unlocking state of the slide door 2, so that the retention of the slide door 2 in the closed state by the front locking member 6 and the rear locking member 7 is released.

As described above, the release (the unlocking) of the retention of the slide door 2 in the closed state by the front locking member 6 and the rear locking member 7 when outside handle 3 is operated while the slide door is in the unlocked state may be easily achieved by the door opening and closing apparatus according to the embodiment having a simple configuration in which the outside lever 35 is configured with the outside handle lever 41 and the release lever 42. Alternatively, the retention of the slide door 2 in the closed state by the front locking member 6 and the rear locking member 7 may be released by the force generated by the release actuator 16 while the slide door is in the locked state.

According to the embodiment, the door opening and closing apparatus further includes the locking lever 37 and the locking actuator 17, wherein the outside lever 35 is linked to the release actuator 16 and is engageable with the front locking member 6 and the rear locking member 7, the locking lever 37 is configured so as to interrupt the operation of the outside lever 35 to the front locking member 6 and the rear locking member 7 in order to turn the slide door 2 to be in the locked state and so as to allow the transmission of the operation of the outside lever 35 to the front locking member 6 and the rear locking member 7 in order to turn the slide door 2 to be in the unlocked state, and wherein the locking actuator 17 is configured so as to actuate the locking lever 37 in order to shift the state of the slide door 2 between the locked state and the unlocked state.

Accordingly, while the slide door 2 is in the unlocked state, the operation of the outside lever in response to the operation to the outside handle 3 is allowed to be transmitted to the front locking member 6 and the rear locking member 7 by the locking lever 37, so that the retention of the slide door 2 in the closed state by the front locking member 6 and the rear locking member 7 is released. Furthermore, while the slide door 2 is in the locked state, the transmission of the operation of the outside lever 35 in response to the operation to the outside handle 3 to the front locking member 6 and the rear locking member 7 is interrupted by the locking lever 37, so that the retention of the slide door 2 in the closed state by the front locking member 6 and the rear locking member 7 is not releasable. In this case, the locking lever 37 is actuated so as to switch the state of the slide door 2 from the locked state to the unlocked state by the locking actuator 17, so that the retention of the slide door 2 in the closed state by the front locking member 6 and the rear locking member 7 is releasable. Similarly, while the slide door 2 is in the locked state, firstly, the locking lever 37 is actuated so as to shift the state of the slide door 2 from the locked state to the unlocked state by the locking actuator 17. Then, the operation of the outside lever 35 in response to the actuation of the release actuator 16 is transmitted to the front locking member 6 and the rear locking member 7, thereby releasing (unlocking) the retention of the slide door 2 in the closed state by the front locking member 6 and the rear locking member 7. As described above, while the slide door 2 is in the locked state, the locking lever 37 is actuated so as to shift the state of the slide door 2 from the locked state to the unlocked state in response to the actuation of the locking actuator 17, so that the retention of the slide door 2 in the closed state by the front locking member 6 and the rear locking member 7 may be released in response to the operation to the outside handle 3 or the force generated by the release actuator 16.

According to the embodiment, the door opening and closing apparatus further includes the lift lever 33, wherein the door opening and closing apparatus for the vehicle includes plural latch mechanisms (the front locking member 6 and the rear locking member 7) and the lift lever 33 distributes the force generated by the release actuator 16 to the front locking member 6 and the rear locking member 7 in order to release the retention of the slide door 2 in the closed state by the plurality of the front locking member 6 and the rear locking member 7.

Accordingly, because the force generated by the release actuator 16 is distributed and transmitted to the front locking member 6 and the rear locking member 7 by the lift lever 33, the force transmission configuration (the force transmission pathway) may be simplified when comparing to, for example, the known door opening and closing apparatus in which a force generated by the release actuator is separately and individually transmitted to plural latch mechanisms.

According to the embodiment, the door opening and closing apparatus further includes the locking lever 37 configure so as to be switchable between the unlock state for allowing the operation force of the outside handle 3 to be transmitted to the front locking member 6 and the rear locking member 7 and the lock state for not allowing the operation force of the outside handle 3 to be transmitted to the front locking member 6 and the rear locking member 7, wherein the locking lever 37 includes a first locking lever 43, which includes the bearing hole 43*a*, and the second locking lever 44, which is adapted to be rotatably supported by the slide door 2 and includes the shaft portion 44*a* that is inserted into the bearing hole 43*a* so that the second locking lever 44 is rotatably supported by the first locking lever 43, the torque spring 55 having the coil portion 55*a* wound around the shaft portion 44*a* and biasing the first and second locking levers 43 and 44 so that the first and second locking levers 43 and 44 form the predetermined angle by which the first and second locking levers 43 and 44 engage with each other, the engagement bore 44*d*, which is formed on the second locking lever 44 and with which the first end portion 55*b* of the torque spring 55 is engaged, the accommodation recessed portion 43*e*, which is formed at the first locking lever 43 so as to be positioned radially outwardly of the bearing hole 43*a* and into which the coil portion 55*a* is accommodated, and the engagement recessed portion 43*f*, which is formed at the accommodation recessed portion 43*e* and into which the second end portion 55*c* of the torque spring 55 slidably moving the accommodation recessed portion 43*e* is fitted in the manner where the first and second locking levers 43 and 44 placed on each other in the state where the shaft portion 44*a* is inserted into the bearing hole 43*a* are rotated relative to each other and which allows the torque spring 55 to generate the biasing force when the first and second locking levers 43 and 44 are further rotated relative to each other until forming the predetermined angle therebetween, and wherein the shaft portion 44*a* is further inserted into the bearing hole 43*a* while the first and second locking levers 43 and 44 form the predetermined angle, so that the first and second locking levers 43 and 44 engage with each other while forming the predetermined angle.

Accordingly, firstly, the first end portion 55*b* of the torque spring 55 is engaged with the engagement bore 44*d* in the state where the coil portion 55*a* is wound around the shaft portion 44*a* upon the assembling of the torque spring 55. Then, the first and second locking levers 43 and 44 are placed on each other in the state where the shaft portion 44*a* is inserted into the bearing hole 43*a*, and the first and second locking levers 43 and 44 are rotated relative to each other, so that the second end portion 55*c* of the torque spring 55 slidably moving within the accommodation recessed portion 43*e* is fitted into and engaged with the engagement recessed portion 43*f*. The first and second locking levers 43 and 44 are further rotated relative to each other until the first and second locking levers 43 and 44 form the predetermined angle in the state where the second end portion 55*c* of the torque spring 55 is engaged with the engagement recessed portion 43*f*. Accordingly, the torque spring 55 generates the biasing force. The shaft portion 44*a* is further inserted into the bearing hole 43*a* in the state where the first and second locking levers 43 and 44 form the predetermined angle, so that the first and second locking levers 43 and 44 engage with each other so as to form the predetermined angle, at which the first and second locking levers 43 and 44 are positioned at the initial position. Accordingly, the assembling of the first and second locking levers 43 and 44 may be enhanced (i.e. the locking lever 37 may be easily assembled).

According to the embodiment, the first locking lever 43 includes the guide surface 43*g* formed at the engagement recessed portion 43*f*, so that the second end portion 55*c* of the torque spring 55 slidably moving within the accommodation recessed portion 43*e* is guided to be fitted into the engagement recessed portion 43*f* by the guide surface 43*g*.

Accordingly, the second end portion 55*c* of the torque spring 55 may be smoothly fitted into and engaged with the engagement recessed portion 43*f* by the guide surface 43*g*.

According to the embodiment, the door opening and closing apparatus further includes the remote controller 5, wherein the door opening and closing apparatus for the vehicle includes plural latch mechanisms (the front locking member 6 and the rear locking member 7), and the locking lever 37 is accommodated within the remote controller 5, which is configured so as to distribute and transmit the operation force of the outside handle 3 to the front locking member 6 and the rear locking member 7.

Accordingly, the locking lever 37, whose size is further reduced when comparing to the known locking lever, may have more flexibility in arrangement within the remote controller 5, which has the limited accommodation space therewithin.

According to the embodiment, the door opening and closing apparatus for the vehicle includes plural latch mechanisms (the front locking member 6 and the rear locking member 7). The first locking lever 43 is linked to the outside handle 3 and is configured so as to be linkable to an open lever 32, which is lined to the front locking member 6 and the rear locking member 7 while the slide door 2 is in the locked state, and the second locking lever 44 is linked to the locking actuator 17 in order to operate a lock knob 53 to be unlocked and locked.

The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

The invention claimed is:

1. A door opening and closing apparatus for a vehicle, comprising:

a control unit configured to authenticate an identification signal outputted from a portable device carried by a user to recognize that the user is approaching the vehicle;

a latch mechanism adapted so as to retain a vehicle door in a closed state relative to a vehicle body;

an outside lever adapted to be provided within a space formed inside of the vehicle door so as to be positioned closer to an interior of the vehicle and linked to an outside handle adapted to be rotatably supported by the vehicle door;

first and second locking levers together defining a locking lever switchable between an unlock state allowing an operation force applied to the outside handle to be transmitted to the latch mechanism and a locked state not allowing the operation force applied to the outside handle to be transmitted to the latch mechanism, the first locking lever locking lever including a stepped portion defining a recess in which a portion of the second locking lever is positioned; the first and second locking levers being rotatable relative to each other;

a detection switch detecting an operation to the outside handle when the outside lever contacts the detection switch in response to a rotational operation of the outside lever; and a release device which actuates the latch mechanism when the control unit authenticates the identification signal outputted from the portable device carried by a user to recognize that the user is approaching the vehicle and when the rotational operation of the outside handle is detected by the detection switch while the vehicle door is in a locked state so that the latch mechanism releases retention of the vehicle door in the closed state.

2. The door opening and closing apparatus for the vehicle according to claim 1 further comprising an opening and closing device adapted to operate the vehicle door to be opened and closed, wherein the latch mechanism includes a latch adapted to retain the vehicle door in a fully-closed state relative to the vehicle body and a full-latch detecting switch for detecting a rotational position of the latch when the vehicle door is in the fully-closed state, the release device actuates the latch mechanism when the operation of the outside handle is detected by the detection switch while the vehicle door is in the locked state, and the opening and closing device controls the vehicle door to be opened when the full-latch detecting switch does not detect that the latch is at the rotational position after the operation of the outside handle is detected by the detection switch while the vehicle door is in the locked state.

3. The door opening and closing apparatus according to claim 1, further comprising a locking-and-unlocking state switching device, wherein the outside lever includes a first lever linked to the outside handle and linkable to the latch mechanism and a second lever linked to the release device and configured so as to transmit a force generated by the release device to the latch mechanism in order to release the retention of the vehicle door in the closed state by the latch mechanism, and wherein the locking-and-unlocking state switching device is configured so as to interrupt a transmission of an operation of the first lever to the latch mechanism in order to turn the vehicle door to be in the locked state and so as to allow the transmission of the operation of the first lever to the latch mechanism in order to turn the vehicle door to be in an unlocked state.

4. The door opening and closing apparatus according to claim 2, further comprising a locking-and-unlocking state switching device, wherein the outside lever includes a first lever linked to the outside handle and linkable to the latch mechanism and a second lever linked to the release device and configured so as to transmit a force generated by the release device to the latch mechanism in order to release the retention of the vehicle door in the closed state by the latch mechanism, and wherein the locking-and-unlocking state switching device is configured so as to interrupt a transmission of an operation of the first lever to the latch mechanism in order to turn the vehicle door to be in the locked state and to allow the transmission of the operation of the first lever to the latch mechanism in order to turn the vehicle door to be in an unlocked state.

5. The door opening and closing apparatus for the vehicle according to claim 1, further comprising a locking-and-unlocking state switching device and a switching drive device, wherein the outside lever is linked to the release device and is engageable with the latch mechanism, the locking-and-unlocking state switching device is configured so as to interrupt an operation of the outside lever to the latch mechanism in order to turn the vehicle door to be in the locked state and so as to allow the transmission of the operation of the outside lever to the latch mechanism in order to turn the vehicle door to be in an unlocked state, and wherein the switching drive device is configured so as to actuate the locking-and-unlocking state switching device in order to shift a state of the vehicle door between the locked state and the unlocked state.

6. The door opening and closing apparatus for the vehicle according to claim 2, further comprising a locking-and-unlocking state switching device and a switching drive device, wherein the outside lever is linked to the release device and is engageable with the latch mechanism, the locking-and-unlocking state switching device is configured so as to interrupt an operation of the outside lever to the latch mechanism in order to turn the vehicle door to be in the locked state and so as to allow the transmission of the operation of the outside lever to the latch mechanism in order to turn the vehicle door to be in an unlocked state, and wherein the switching drive device is configured so as to actuate the locking-and-unlocking state switching device in order to shift a state of the vehicle door between the locked state and the unlocked state.

7. The door opening and closing apparatus for the vehicle according to claim 1, further comprising a relay lever, wherein the door opening and closing apparatus for the vehicle includes a plurality of the latch mechanisms and the relay lever distributes a force generated by the release device to the plurality of the latch mechanisms in order to release the retention of the vehicle door in the closed state by the plurality of the latch mechanisms.

8. The door opening and closing apparatus for the vehicle according to claim 2, further comprising a relay lever, wherein the door opening and closing apparatus for the vehicle includes a plurality of the latch mechanisms and the relay lever distributes a force generated by the release device to the plurality of the latch mechanisms in order to release the retention of the vehicle door in the closed state by the plurality of the latch mechanisms.

9. The door opening and closing apparatus for the vehicle according to claim 3, further comprising a relay lever, wherein the door opening and closing apparatus for the vehicle includes a plurality of the latch mechanisms and the relay lever distributes the force generated by the release device to the plurality of the latch mechanisms in order to release the retention of the vehicle door in the closed state by the plurality of the latch mechanisms.

10. The door opening and closing apparatus for the veichle according to claim 4, further comprising a relay lever, wherein the door opening and closing apparatus for the vehicle includes a plurality of the latch mechanisms and the relay lever distributes the force generated by the release device to the plurality of the latch mechanisms in order to release the retention of the vehicle door in the closed state by the plurality of the latch mechanisms.

11. The door opening and closing apparatus for the vehicle according to claim 5, further comprising a relay lever, wherein the door opening and closing apparatus for the vehicle includes a plurality of the latch mechanisms and the relay lever distributes a force generated by the release device to the plurality of the latch mechanisms in order to release the retention of the vehicle door in the closed state by the plurality of the latch mechanisms.

12. The door opening and closing apparatus for the vehicle according to claim 6, further comprising a relay lever, wherein the door opening and closing apparatus for the vehicle includes a plurality of the latch mechanisms and the relay lever distributes a force generated by the release device to the plurality of the latch mechanisms in order to release the retention of the vehicle door in the closed state by the plurality of the latch mechanisms.

13. The door opening and closing apparatus according to claim 1, wherein the first locking lever includes a bearing hole, and the second locking lever is adapted to be rotatably supported by the vehicle door and includes a shaft portion that is inserted into the bearing hole so that the second locking lever is rotatably supported by the first locking lever, a biasing device having a coil portion wound around the shaft portion and biasing the first and second locking levers so that the first and second locking levers form a predetermined angle by which the first and second locking levers engage with each other, a first engagement portion, which is formed on the second locking lever and with which a first end portion of the biasing device is engaged, an accommodation recessed portion, which is formed at the first locking lever so as to be positioned radially outwardly of the bearing hole and into which the coil portion is accommodated, and a second engagement recessed portion, which is formed at the accommodation recessed portion and into which a second end portion of the biasing device which is slidably movable in the accommodation recessed portion is fitted in a manner where the first and second locking levers placed on each other in a state where the shaft portion is inserted into the bearing hole are rotated relative to each other and which allows the biasing device to generate a biasing force when the first and second locking levers are further rotated relative to each other until forming a predetermined angle therebetween, and wherein the shaft portion is further inserted into the bearing hole while the first and second locking levers form the predetermined angle, so that the first and second locking levers engage with each other while forming the predetermined angle.

14. The door opening and closing apparatus for the vehicle according to claim 13, wherein the first locking lever includes a guide surface formed at the second engagement recessed portion, so that the second end portion of the biasing device slidably moving within the accommodation recessed portion is guided to be fitted into the second engagement recessed portion by the guide surface.

15. The door opening and closing apparatus for the vehicle according to claim 13, further comprising a relay device, wherein the door opening and closing apparatus for the vehicle includes a plurality of the latch mechanisms, and the locking lever is accommodated within the relay device, which is configured so as to distribute and transmit the operation force of the outside handle to the plurality of the latch mechanisms.

16. The door opening and closing apparatus for the vehicle according to claim 14, further comprising a relay device, wherein the door opening and closing apparatus for the vehicle includes a plurality of the latch mechanisms, and the locking lever is accommodated within the relay device, which is configured so as to distribute and transmit the operation force of the outside handle to the plurality of the latch mechanisms.

17. The door opening and closing apparatus for the vehicle according to claim 13, wherein the door opening and closing apparatus for the vehicle includes a plurality of the latch mechanisms, the first locking lever is linked to the outside handle and is configured so as to be linkable to an open lever, which is linked to the plurality of the latch mechanisms while the vehicle door is in the locked state, and the second locking lever is linked to a locking actuator in order to operate a lock knob to be unlocked and locked.

18. The door opening and closing apparatus for the vehicle according to claim 14, wherein the door opening and closing apparatus for the vehicle includes a plurality of the latch mechanisms, the first locking lever is linked to the outside handle and is configured so as to be linkable to an open lever, which is linked to the plurality of the latch mechanisms while the vehicle door is in the locked state, and the second locking lever is linked to a locking actuator in order to operate a lock knob to be unlocked and locked.

19. The door opening and closing apparatus for the vehicle according to claim 15, wherein the first locking lever is linked to the outside handle and is configured so as to be linkable to an open lever, which is lined to the plurality of the latch mechanisms while the vehicle door is in the locked state, and the second locking lever is linked to a locking actuator in order to operate a lock knob to be unlocked and locked.

20. The door opening and closing apparatus for the vehicle according to claim 16, wherein the first locking lever is linked to the outside handle and is configured so as to be linkable to an open lever, which is lined to the plurality of the latch mechanisms while the vehicle door is in the locked state, and the second locking lever is linked to a locking actuator in order to operate a lock knob to be unlocked and locked.

21. A vehicle door opening and closing apparatus mounted on a vehicle door of a vehicle, the vehicle door possessing an outer door panel possessing an inner surface side facing towards a space inside the vehicle door and an oppositely facing outer surface side, the vehicle door opening and closing apparatus comprising:

a control unit configured to authenticate an identification signal outputted from a portable device carried by a user to recognize that the user is approaching the vehicle;

a latch mechanism mounted on the vehicle door and configured to retain the vehicle door in a closed state relative to a vehicle body of the vehicle;

an outside handle rotatably supported on the outer surface side of the outer door panel;

an outside lever positioned within the space inside the vehicle door and linked to the outside handle so that rotational operation of the outside handle causes movement of the outside lever;

first and second locking levers together defining a locking lever switchable between an unlock state allowing an operation force applied to the outside handle to be transmitted to the latch mechanism and a locked state not allowing the operation force applied to the outside handle to be transmitted to the latch mechanism, the first locking lever locking lever including a stepped portion defining a recess in which a portion of the second locking lever is positioned; the first and second locking levers being rotatable relative to each other;

a detection switch positioned to be contacted by the outside lever when the outside lever moves as a result of the rotational operation of the outside handle so that the detection switch detects the rotational operation of the outside handle when the detection switch is contacted by the outside lever; and a release device operatively connected to the latch mechanism to actuate the latch mechanism and release retention of the vehicle door in the closed state when the control unit authenticates the identification signal outputted from the portable device carried by a user to recognize that the user is approaching the vehicle and when the detection switch detects rotational operation of the outside handle while the vehicle door is in a locked state.

22. The door opening and closing apparatus for the vehicle according to claim 21, wherein the detection switch is positioned within the space inside the vehicle door.

* * * * *